US008133536B2

(12) United States Patent
Mataki et al.

(10) Patent No.: US 8,133,536 B2
(45) Date of Patent: Mar. 13, 2012

(54) LIQUID COATING METHOD, LIQUID COATING DEVICE, AND METHOD OF MANUFACTURING RADIATION DETECTOR

(75) Inventors: Hiroshi Mataki, Kanagawa-ken (JP); Hirotaka Watano, Kanagawa-ken (JP); Seiichi Inoue, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 414 days.

(21) Appl. No.: 12/382,975

(22) Filed: Mar. 27, 2009

(65) Prior Publication Data

US 2009/0244144 A1 Oct. 1, 2009

(30) Foreign Application Priority Data

Mar. 28, 2008 (JP) ..... 2008-087673

(51) Int. Cl.
*B05D 5/00* (2006.01)
*B05C 11/10* (2006.01)

(52) U.S. Cl. ..... 427/256; 427/427.2; 427/466; 118/665; 118/679; 347/14; 347/44

(58) Field of Classification Search ..... 118/665, 118/679; 427/256, 427.2, 466; 347/14, 44
See application file for complete search history.

(56) References Cited

U.S. PATENT DOCUMENTS

| | | | | |
|---|---|---|---|---|
| 5,563,421 | A | 10/1996 | Lee et al. | |
| 2005/0100658 | A1 * | 5/2005 | MacPherson et al. | 427/58 |
| 2005/0168526 | A1 * | 8/2005 | Yamada | 347/43 |

FOREIGN PATENT DOCUMENTS

| | | | |
|---|---|---|---|
| JP | 09-009153 | | 1/1997 |
| JP | 2003-280535 | A | 10/2003 |
| JP | 2006-130436 | A | 5/2006 |

* cited by examiner

*Primary Examiner* — George Koch
(74) *Attorney, Agent, or Firm* — Jean C. Edwards, Esq.; Edwards Neils PLLC

(57) ABSTRACT

The liquid coating method includes the step of ejecting droplets from nozzles of a recording head onto an imaging region of a surface of a substrate placed on a support plate, wherein a dot pitch $\phi$ that is an interval between landing positions of the droplets on the surface of the substrate satisfies a following condition:

$$\phi \leq 2\sqrt[3]{\frac{3V(1+\cos\theta_a)\sin\theta_a}{\pi(1-\cos\theta_a)(2+\cos\theta_a)}}$$

where V stands for a volume of a droplet ejected from each of the nozzles and $\theta_a$ stands for an advancing contact angle of the droplet against the substrate.

13 Claims, 31 Drawing Sheets

(A)

LIQUID COATING METHOD, LIQUID COATING DEVICE, AND METHOD OF MANUFACTURING RADIATION DETECTOR

CROSS-REFERENCE TO RELATED APPLICATION

This application claims priority under 35 USC 119 from Japanese Patent Application No. 2008-087673, filed Mar. 28, 2008, the disclosure of which is incorporated herein by reference.

BACKGROUND OF THE INVENTION

1. Field of the Invention

The present invention relates to a liquid coating method, a liquid coating device, and a method of manufacturing a radiation detector, and more particularly to a liquid coating method and a liquid coating device in which a liquid is applied on a surface of a substrate by using an ink jet head.

2. Description of the Related Art

Japanese Patent Application Publication No. 2006-130436 discloses a liquid ejection device comprising an ejection head in which a plurality of nozzles are arranged in rows, wherein the ejection head and a substrate are arranged to form a predetermined angle within a plane substantially perpendicular to the direction in which the ejection head and the substrate are scanned (moved) relative to each other.

When liquid droplets are applied on the entire surface of an imaging region on a substrate serving as a medium by using an ink jet, all the droplets that have landed on the substrate have to be united so that no gap occurs therebetween. The distance (dot pitch) between the droplets landing on the imaging surface has to be optimized in order to unite the droplets so that no gap occurs in the imaging region and to prevent the liquid from protruding from the imaging region.

Japanese Patent Application Publication No. 2006-130436 describes optimizing the relationship between a nozzle pitch and a landing distance (dot pitch) of droplets by arranging the ejection head and substrate at a predetermined angle. However, Japanese Patent Application Publication No. 2006-130436 has absolutely no description relating to a method of determining a dot pitch necessary to unite all the droplets.

SUMMARY OF THE INVENTION

The present invention has been contrived to resolve this problem and it is an object of the present invention to provide a liquid coating method, a liquid coating device, and a method of manufacturing a radiation detector that make it possible to unite droplets within a predetermined imaging region on a substrate so that no gap occurs therebetween and prevent the liquid from protruding from the imaging region.

In order to attain an object described above, one aspect of the present invention is directed to a liquid coating method comprising the step of ejecting droplets from nozzles of a recording head onto an imaging region of a surface of a substrate placed on a support plate, wherein a dot pitch $\phi$ that is an interval between landing positions of the droplets on the surface of the substrate satisfies a following condition:

$$\phi \le 2\sqrt[3]{\frac{3V(1+\cos\theta_a)\sin\theta_a}{\pi(1-\cos\theta_a)(2+\cos\theta_a)}}$$

where V stands for a volume of a droplet ejected from each of the nozzles and $\theta_a$ stands for an advancing contact angle of the droplet against the substrate.

Desirably, the advancing contact angle $\theta_a$ and a receding contact angle $\theta_r$ standing for a receding contact angle of the droplet ejected from each of the nozzles against the substrate satisfy a following condition:

$$\theta_r \le 2\arctan\left\{\frac{\pi}{3}\frac{(1-\cos\theta_a)(2+\cos\theta_a)}{(1+\cos\theta_a)\sin\theta_a}\frac{r^2}{\phi^2}\right\} \le \theta_a$$

where r stands for a radius of one droplet with the volume V on the surface of the substrate when the one droplet has wetly spread under condition of the advancing contact angle $\theta_a$.

Desirably, the advancing contact angle $\theta_a$ and the receding contact angle $\theta_r$ satisfy a following condition:

$$\theta_r \le 2\arctan\left\{\frac{\pi}{12}\frac{(1-\cos\theta_a)(2+\cos\theta_a)}{(1+\cos\theta_a)\sin\theta_a}\right\} \le \theta_a.$$

Desirably, the imaging region is a rectangular region having a size $L_a$ in a first direction and a size $L_b$ in a second direction perpendicular to the first direction, and the droplets are caused to land substantially equidistantly with an interval equal to or larger than $L_a/(2r)$ in the first direction and an interval equal to or larger than $L_b/(2r)$ in the second direction.

Desirably, wherein when the droplets are ejected onto the imaging region, only one scanning is performed over the imaging region.

In order to attain an object described above, another aspect of the present invention is directed to a liquid coating device comprising: a support plate onto which a substrate is placed; a recording head having a plurality of nozzles that eject droplets on an imaging region of a surface of the substrate placed on the support plate; and a control device controlling ejection from the recording head in such a manner that a volume V of a droplet ejected from each of the plurality of nozzles of the recording head onto the substrate satisfies the following condition:

$$V \ge \frac{\pi}{24}\frac{(1-\cos\theta_a)(2+\cos\theta_a)}{(1+\cos\theta_a)\sin\theta_a}\phi^3$$

where $\theta_a$ stands for an advancing contact angle of the droplet against the substrate and $\phi$ stands for a dot pitch that is an interval between landing positions of the droplets on the surface of the substrate.

Desirably, the control device controls the ejection from the recording head in such a manner that a receding contact angle $\theta_r$ of a droplet ejected from each of the plurality of nozzles against the substrate satisfies a following condition:

$$\theta_r \le 2\arctan\left\{\sqrt[3]{\frac{\pi}{3}\frac{(1-\cos\theta_a)(2+\cos\theta_a)}{(1+\cos\theta_a)\sin\theta_a}V^2}\frac{1}{\phi^2}\right\} \le \theta_a.$$

Desirably, the control device controls the ejection from the recording head in such a manner that the advancing contact angle $\theta_a$ and the receding contact angle $\theta_r$ satisfy a following condition:

$$\theta_r \leq 2\arctan\left\{\sqrt[3]{\frac{\pi}{3}\frac{(1-\cos\theta_a)(2+\cos\theta_a)}{(1+\cos\theta_a)\sin\theta_a}V^2\frac{1}{4r^2}}\right\} \leq \theta_a$$

where r stands for a radius of one droplet with the volume V on the surface of the substrate when the one droplet has wetly spread under condition of the advancing contact angle $\theta_a$.

Desirably, when the imaging region is a rectangular region having a size $L_a$ in a first direction and a size $L_b$ in a second direction perpendicular to the first direction, the control device controls the ejection from the recording head in such a manner that the droplets are caused to land substantially equidistantly with an interval equal to or larger than $L_a/(2r)$ in the first direction and an interval equal to or larger than $L_b/(2r)$ in the second direction.

Desirably, the liquid coating device further comprises a scanning device which performs relative scanning of the recording head and the substrate relative, wherein when the droplets are ejected onto the imaging region, the scanning device performs the relative scanning in such a manner that only one scanning is performed over the imaging region.

Desirably, a nozzle pitch of the recording head corresponds to the dot pitch.

Desirably, a nozzle pitch of the recording head is integral multiple of the dot pitch.

In order to attain an object described above, one aspect of the present invention is directed to a method of manufacturing a radiation detector which has: a first electrode that transmits a radiation that carries image information; a photoconductive layer that generates an electric charge when irradiated with the radiation transmitted through the first electrode; a second electrode that is provided on a side opposite to a side where the first electrode is provided with respect to the photoconductive layer and that collects the electric charge generated by the photoconductive layer; and an organic polymer layer provided between the photoconductive layer and the first electrode, the method comprising the step of forming the organic polymer layer using one of the above-described liquid coating methods.

In accordance with the present invention, time required for applying the liquid can be shortened and the amount of liquid consumed when the liquid is applied on the entire surface of the imaging region on the surface of the substrate can be reduced.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Configuration of Liquid Coating Device

Figure 1:
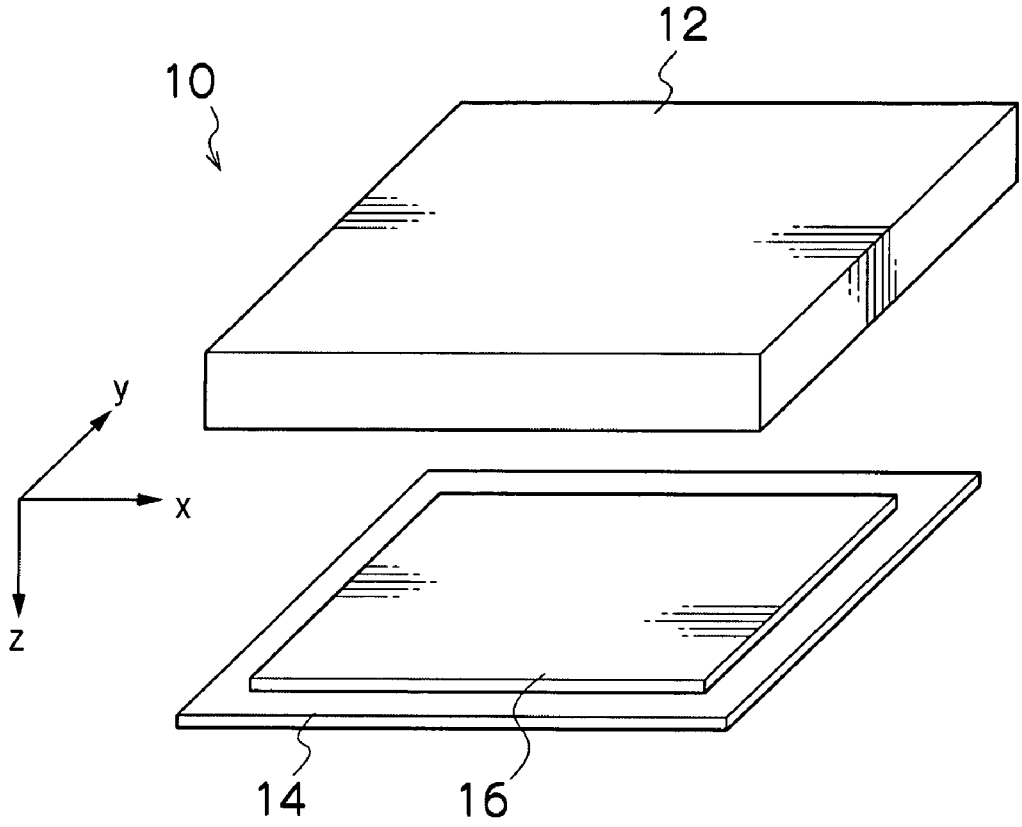
FIG. 1 is a perspective view illustrating a liquid coating device of a first embodiment of the present invention.

FIG. 1 is a perspective view illustrating a liquid coating device of a first embodiment of the present invention.

As illustrated in FIG. 1, the liquid coating device (ink jet recording device) 10 of the present embodiment includes an ink jet head (referred to hereinbelow as "recording head") 12 and a support plate 14.

A substrate 16 that is an object of applying a liquid with the recording head 12 is placed on the support plate 14.

In the recording head 12, nozzles 22 are arranged side by side over the entire width in the x direction and y direction of an object region (referred to hereinbelow as "imaging region") of the substrate 16 that is to be coated with the liquid.

The recording head 12 is supported so that a constant clearance is maintained between the recording head and the support plate 14, and the substrate 16 is placed on the support plate 14 so that the recording head 12 and the imaging region overlap. As a result, the liquid can be applied (deposited) on the entire surface of the imaging region of the substrate 16 by ejecting all the droplets at once from the nozzles 22 of the recording head 12.

Figure 2:
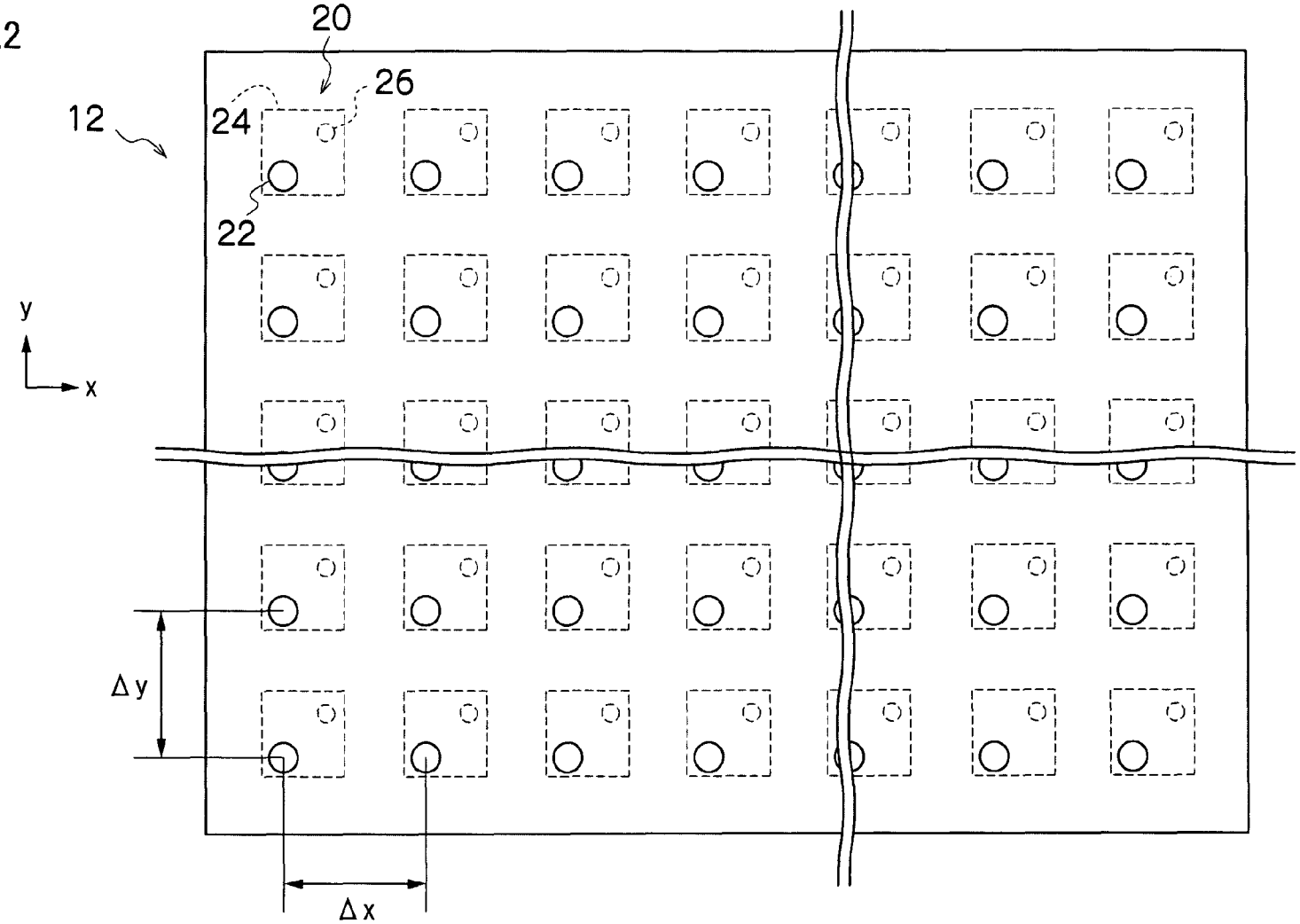
FIG. 2 is a plan view illustrating a plane formed by a nozzle of a recording head 12.

FIG. 2 is a plan view illustrating a surface where the nozzles of the recording head 12 are formed.

As illustrated in FIG. 2, the recording head 12 has a structure in which ejection elements 20, each having a nozzle 20 and a pressure chamber 24, are arranged substantially equidistantly along the sub-scanning direction (y direction) substantially perpendicular to the main scanning direction (x direction).

A nozzle diameter in the recording head 12 is, for example, 35 μm and a nozzle pitch is 254 μm (100 npi). The recording head 12 has a jet-out period of 1 kHz, and droplets can be continuously jetted out at a head scanning rate of 0.1 m/sec.

When the recording head 12 has a high-density configuration such that dots formed by the droplets jetted out from the adjacent nozzles overlap, an operation mode is preferred in which thinning control is conducted such that droplets are jetted out simultaneously from every other nozzle, rather than from the adjacent nozzles, and the jetting-out process is divided into two cycles.

As illustrated in FIG. 2, pressure chambers 24 provided correspondingly to nozzles 22 have a substantially square shape in a plan view thereof. An outflow port leading to the nozzle 20 is provided in one inner corner on a diagonal line of the pressure chamber 24, and a liquid supply port 26 leading to the pressure chamber 24 is provided in the other corner. In addition to the aforementioned square shape, the pressure chamber 24 can have a polygonal shape such as tetragonal shape (rhomboidal shape, rectangular shape), pentagonal shape, or hexagonal shape, and also round shape or elliptical shape.

Figure 3:
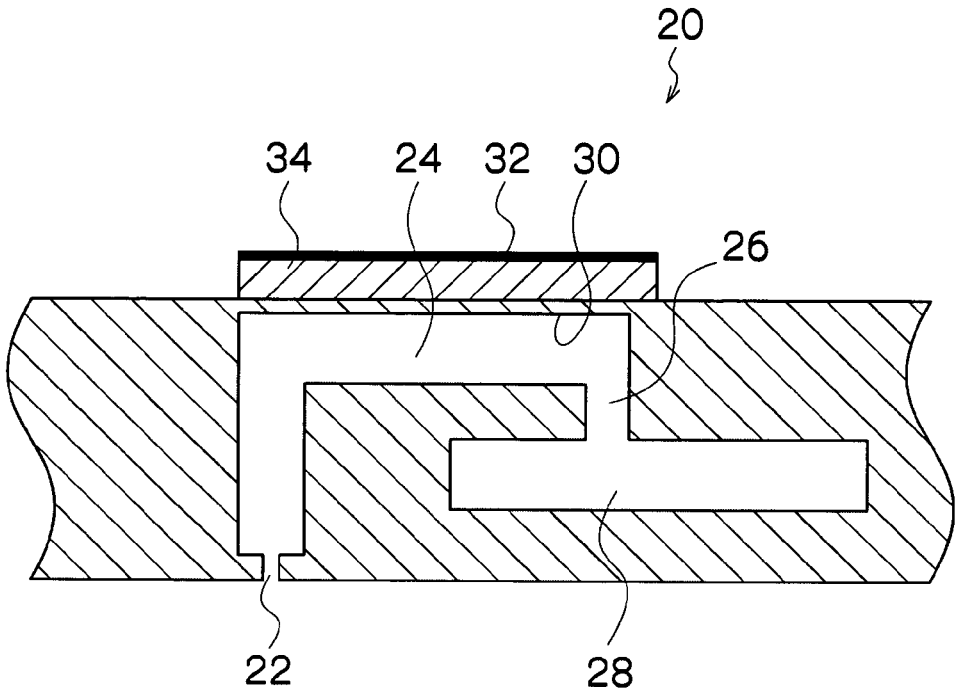
FIG. 3 is a cross-sectional view of an ejection element 20.

FIG. 3 is a cross-sectional view of the ejection element 20.

As illustrated in FIG. 3, the pressure chamber 24 of the ejection element 20 is linked to a common channel 28 via the supply port 26. The common channel 28 is linked to a tank (not illustrated in the figure) that serves as a liquid supply source, and the liquid supplied from the tank is distributed and supplied to the pressure chambers 24 via the common channel 28.

A piezoelectric element 34 provided with an individual electrode 32 is bonded to a pressure plate (oscillation plate also serving as a common electrode) 30 constituting part of the surface (top surface in FIG. 3) of the pressure chamber 24. For example, a piezoelectric material such as lead zirconium titanate (PZT) or barium titanate can be used as a material for the piezoelectric element 34.

Where a drive signal is applied between the individual electrode 32 and the common electrode, the piezoelectric element 34 is deformed and the volume of the pressure chamber 24 changes. As a result, the pressure inside the pressure chamber 24 changes, thereby ejecting a droplet from the nozzle 22. After the droplet has been ejected, the displacement of the piezoelectric element 34 returns to the original state, and the pressure chamber 24 is refilled with new liquid from the common channel 28 via the supply port 26.

In the present embodiment, a system is employed by which ink is pressurized by the deformation of the piezoelectric element 34, but actuators of other systems (for example, a thermal system) may be also employed.

The liquid coating device 10 has a supply system for supplying liquid to the recording head 12 and a maintenance system for performing maintenance of the recording head 12 (these systems are not illustrated in the figure).

Figure 4:
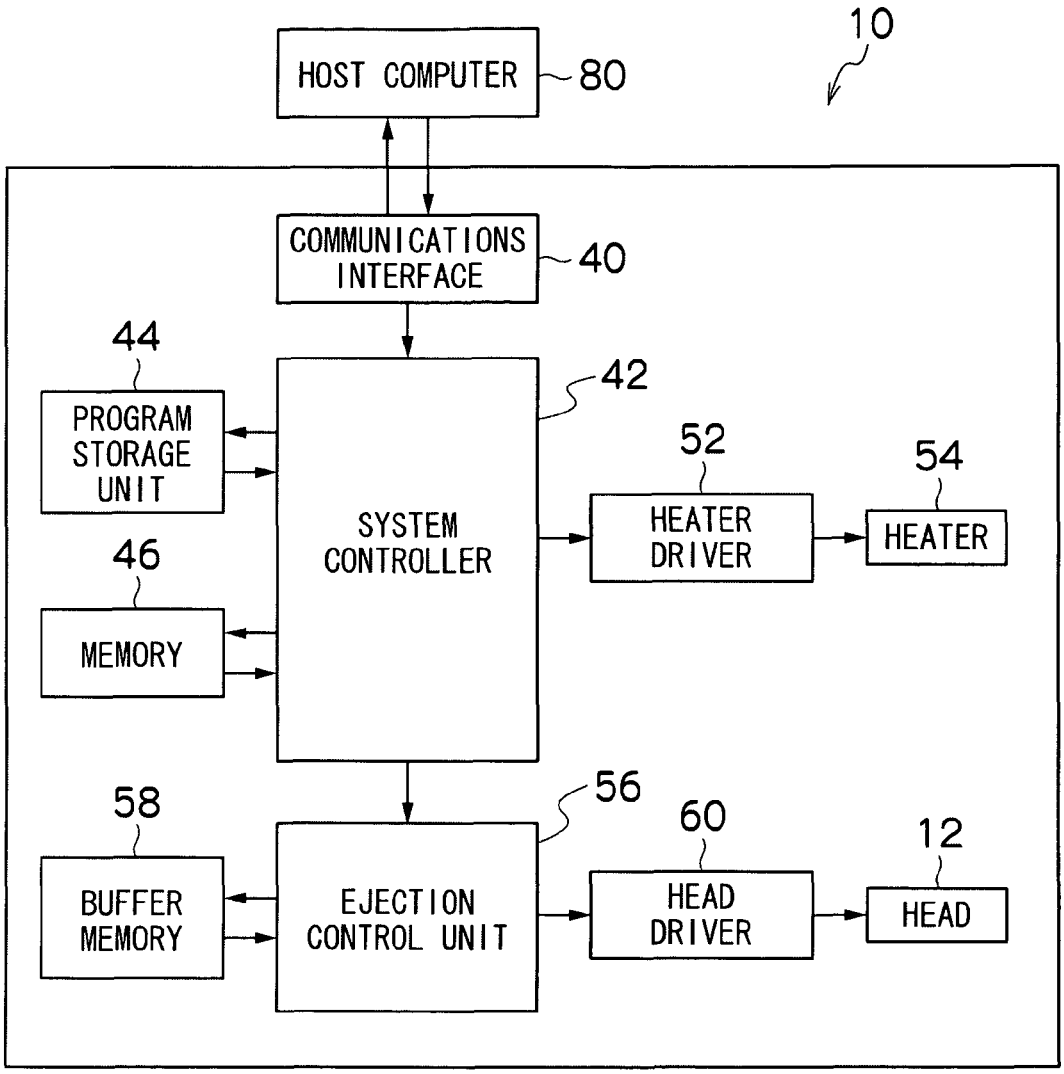
FIG. 4 is a block diagram illustrating a control system of the liquid coating device of the first embodiment of the present invention.

FIG. 4 illustrates a block diagram indicating a control system of the liquid coating device.

The liquid coating device 10 includes a communications interface 40, a system controller 42, a memory 46, a heater driver 52, an ejection control unit 56, a buffer memory and a head driver 60.

The communications interface 40 functions as an interface unit receiving ejection date sent from a host computer 80. As the communications interface 40, USB (Universal Serial Bus), IEEE 1394, Ethernet (registered trademark), wireless network, other serial networks, parallel interface such as Centronics may be used. Further, a buffer memory may be mounted on this portion in order to speed up the communications.

The system controller 42 includes a CPU (central processing unit) and the peripheral circuits, and functions as a control unit controlling each section of the liquid coating device 10. This system controller 42 controls the communications with the host computer 80, controls read-in and writing-in the memory 46, generates control signals to control the motors of the conveyance drive system and the heater 54, and performs other control.

Control programs of the liquid coating device 10 are stored in a program storage unit 44. The system controller 42 reads out various sorts of control programs stored in the program storage unit 44 and performs the read-out programs in a proper manner.

The memory 46 is a memory device used as a temporary storage area of date and a working area when the system controller 42 carries out various sorts of calculations. As the memory 46, a memory formed from a semiconductor element, or a magnetic medium such as a hard disk may be used.

The heater driver 52 drives the heater 54 in accordance with control signals from the system controller 42. The heater 54 includes heaters for adjusting temperature provided on parts of the liquid coating device 10.

The ejection date sent from the host computer 80 is sent into the liquid coating device 10 via the communications interface 40, and is temporarily stored in the memory 46.

The ejection control unit 56 has a signal processing function to carry out various processing and correction to generate signals for controlling the ejection from the ejection data stored in the memory 46 in accordance with the control by the system controller 42, and supplies the generated print control signals (dot data) to the head driver 60. Required signal processing is carried out in the ejection control unit 56, and the ejection amount and the ejection timing of the liquid from the head 12 are controlled via the head driver 60, on the basis of the ejection data.

The head driver 60 drives the piezoelectric elements 34 of the recording head 12 on the basis of the ejection data supplied from the ejection control unit 56. The head driver 60 may include a feedback control system to maintain uniform drive conditions of the head.

The ejection control unit 56 is provided with a buffer memory 58; and ejection data, parameters, and other data are temporarily stored in the buffer memory 58 when the ejection data is processed in the ejection control unit 56.

It is possible to use the buffer memory 58 as the memory 46. It is also possible to integrate the ejection control unit 56 and the system controller 42 in such a manner that both the ejection control unit 56 and the system controller 42 are realized by one processor.

Droplet Coating Conditions

Conditions under which droplets are united on the surface of the substrate 16 will be explained below.

Figure 5:
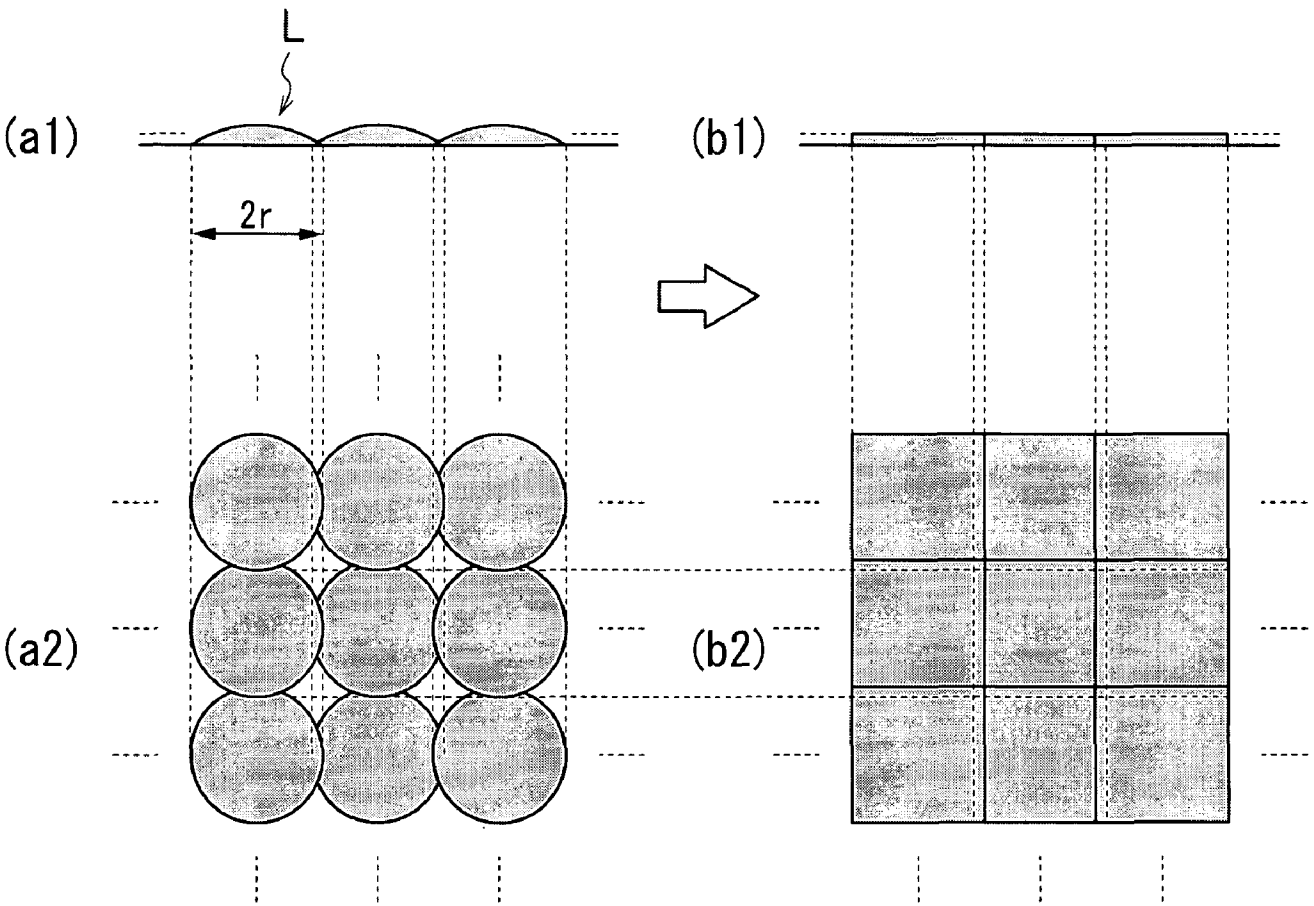
FIG. 5 schematically illustrates the variation with time of a droplet that has landed on the surface of a substrate 16.

FIG. 5 illustrates schematically how the droplets that have landed on the surface of the substrate 16 change with time. The "a1" part and "b1" part of FIG. 5 are cross-sectional views, and the "a2" part and "b2" part of FIG. 5 are plan views.

As illustrated in the "a1" part "a2" of FIG. 5, each droplet L that has been ejected from the recording head 12 and landed on the surface of the substrate 16 has a substantially round shape at the initial stage of landing and is in contact with the adjacent droplets. Then, as illustrated in the "b1" part and "b2" part of FIG. 5, each droplet L spreads due to wetting (wetly spreads) and the entire surface of the rectangular region A10 is coated with the liquid.

Where a radius of the droplet L that has spread on the surface of the substrate 16 due to wetting is denoted by r and an advancing contact angle is denoted by $\theta_a$, the volume V of the droplet L can be represented by Formula (1) below. In the explanation below, the substrate 16 is assumed to be from a medium that is impermeable to the droplet L (the droplet does not penetrate into the medium).

$$V = \frac{\pi}{3}\frac{(1-\cos\theta_a)(2+\cos\theta_a)}{(1+\cos\theta_a)\sin\theta_a} \qquad \text{Formula (1)}$$

By modifying Formula (1) above, it is possible to represent the radius r of the droplet L that has spread on the surface of the substrate 16 due to wetting by the following Formula (2).

$$r = \sqrt[3]{\frac{3}{\pi}\frac{(1+\cos\theta_a)\sin\theta_a}{(1-\cos\theta_a)(2+\cos\theta_a)}V} \qquad \text{Formula (2)}$$

For the adjacent droplets L to abut and be united, the distance (referred to hereinbelow as "dot pitch") $\phi$ between the centers of the adjacent droplets L has to be equal to or less than 2r. Where Formula (2) above is substituted in $\phi \leqq 2r$, the following Formula (3) is obtained.

$$\phi \le 2\sqrt[3]{\frac{3V(1+\cos\theta_a)\sin\theta_a}{\pi(1-\cos\theta_a)(2+\cos\theta_a)}} \qquad \text{Formula (3)}$$

By modifying Formula (3) above, it is possible to obtain Formula (3') representing a condition relating to an injection volume V of a droplet from each nozzle.

$$V \ge \frac{\pi}{24}\frac{(1-\cos\theta_a)(2+\cos\theta_a)}{(1+\cos\theta_a)\sin\theta_a}\phi^3 \qquad \text{Formula (3')}$$

Figure 6:
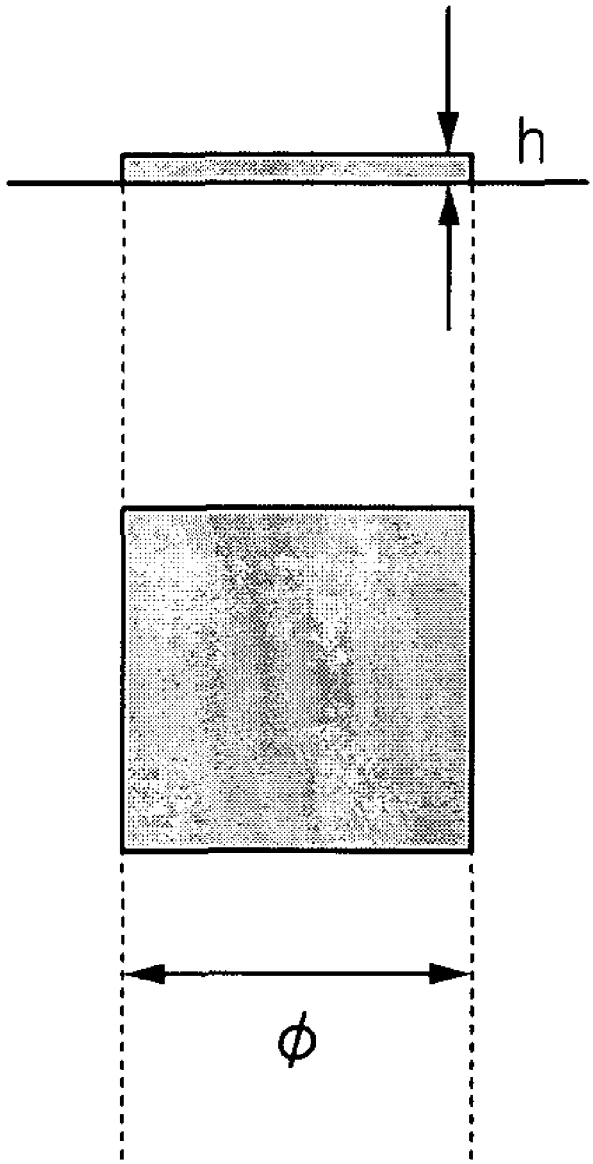
FIG. 6 is a cross-sectional view illustrating a droplet that expanded due to wetting.

As illustrated in FIG. 6, a thickness h of the droplet L after it has spread due to wetting can be represented by $h=V/\phi^2$ if the droplet L is taken as a rectangular parallelepiped. The following Formula (4) can be obtained by substituting Formula (I) above into $h=V/\phi^2$.

$$h = \frac{V}{\phi^2} = \frac{\pi}{3}\frac{(1-\cos\theta_a)(2+\cos\theta_a)}{(1+\cos\theta_a)\sin\theta_a}\frac{r^3}{\phi^2} \qquad \text{Formula (4)}$$

Figure 7:
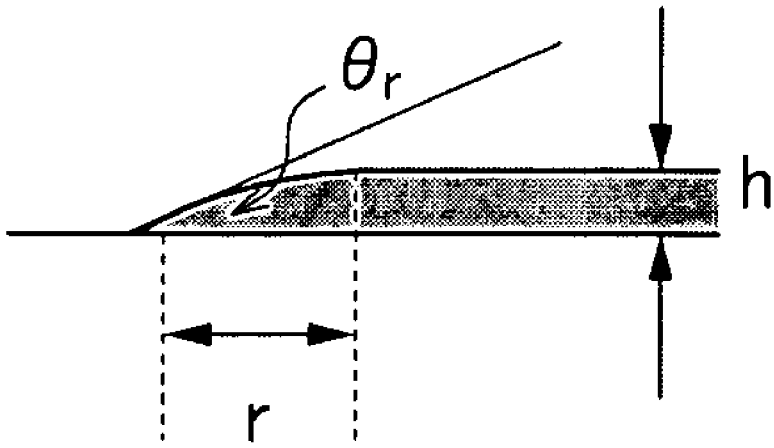
FIG. 7 is a cross-sectional view illustrating a receding contact angle of a droplet.

As illustrated in FIG. 7, where the receding contact angle of the droplet L is denoted by $\theta_r$, a condition of the droplet L not shrinking on the surface of the substrate 16 can be represented by $\theta_r \leqq 2\arctan(h/r)$. By substituting Formula (4) above into $\theta_r \leqq 2\arctan(h/r)$, the following Formula (5) can be obtained.

$$\theta_r \le 2\arctan\frac{h}{r} = 2\arctan\left\{\frac{\pi}{3}\frac{(1-\cos\theta_a)(2+\cos\theta_a)}{(1+\cos\theta_a)\sin\theta_a}\frac{r^2}{\phi^2}\right\} \qquad \text{Formula (5)}$$

Where $\phi=2r$ (that is, a maximum value of dot pitch $\phi$ satisfying the condition (Formula (3)) under which the adjacent droplets L abut) is substituted in Formulas (4) and (5) above, the following Formulas (6) and (7) can be obtained.

$$h = \frac{V}{4r^2} = \frac{\pi}{12}\frac{(1-\cos\theta_a)(2+\cos\theta_a)}{(1+\cos\theta_a)\sin\theta_a}r \qquad \text{Formula (6)}$$

$$\theta_r \le 2\arctan\frac{h}{r} = 2\arctan\left\{\frac{\pi}{12}\frac{(1-\cos\theta_a)(2+\cos\theta_a)}{(1+\cos\theta_a)\sin\theta_a}\right\} \qquad \text{Formula (7)}$$

The range in which the droplet L spreads due to wetting can be then adequately controlled by making the advancing contact angle $\theta_a$ to satisfy the condition represented by the following Formula (8).

$$\theta_r \le 2\arctan\left\{\frac{\pi}{3}\frac{(1-\cos\theta_a)(2+\cos\theta_a)}{(1+\cos\theta_a)\sin\theta_a}\frac{r^2}{\phi^2}\right\} \le \theta_a \qquad \text{Formula (8)}$$

Where Formula (8) above is modified, the following Formula (9) can be obtained.

$$\theta_r \le 2\arctan\left\{\sqrt[3]{\frac{\pi}{3}\frac{(1-\cos\theta_a)(2+\cos\theta_a)}{(1+\cos\theta_a)\sin\theta_a}V^2}\frac{1}{\phi^2}\right\} \le \theta_a \qquad \text{Formula (9)}$$

By substituting $\phi=2r$ in Formulas (8) and (9) above, it is possible to obtain the following Formulas (8') and (9'), respectively.

$$\theta_r \le 2\arctan\left\{\frac{\pi}{12}\frac{(1-\cos\theta_a)(2+\cos\theta_a)}{(1+\cos\theta_a)\sin\theta_a}\right\} \le \theta_a \quad \text{Formula (8')}$$

$$\theta_r \le 2\arctan\left\{\sqrt[3]{\frac{\pi}{3}\frac{(1-\cos\theta_a)(2+\cos\theta_a)}{(1+\cos\theta_a)\sin\theta_a}V^2}\,\frac{1}{4r^2}\right\} \le \theta_a \quad \text{Formula (9')}$$

As illustrated in FIG. 1, in the present embodiment, the liquid is applied in a state in which both the recording head 12 and the substrate 16 are stationary. Therefore, both nozzle pitches Δx and Δy in the directions x and y of the recording head 12 have to match the dot pitch ϕ satisfying the condition represented by Formula (3) above. For example, when the recording head 12 illustrated in FIG. 1 ejects a very large droplet, ejects droplets on a substrate with very high lyophilicity, or ejects a droplet on a thin and long substrate, the recording head 12 such as illustrated in FIG. 1 can be configured to apply a liquid, without scanning.

With the present embodiment, where the dot pitch ϕ and volume V are controlled based on the conditions (3) and (3') for causing the droplets to come into contact with each other and be united on the surface of the substrate 16 on the basis of the advancing contact angle $\theta_a$ between the substrate 16 and the coating liquid and the droplet volume V and where the values of the advancing contact angle $\theta_a$ and receding contact angle $\theta_r$ of the substrate 16 and the coating liquid satisfy the conditions (8), (8'), (9) and (9'), the droplets can be reliably applied on the imaging region of the surface of the substrate 16, without gaps and without oozing from the imaging region. Furthermore, with the liquid coating device 10 of the present embodiment where the above-described conditions are satisfied, the liquid coating rate can be increased and consumption of liquid in coating on the entire surface of the imaging region can be minimized.

Other Embodiments of Liquid Coating Device

Other embodiments of the liquid coating device 10 will be explained below.

Figure 8:
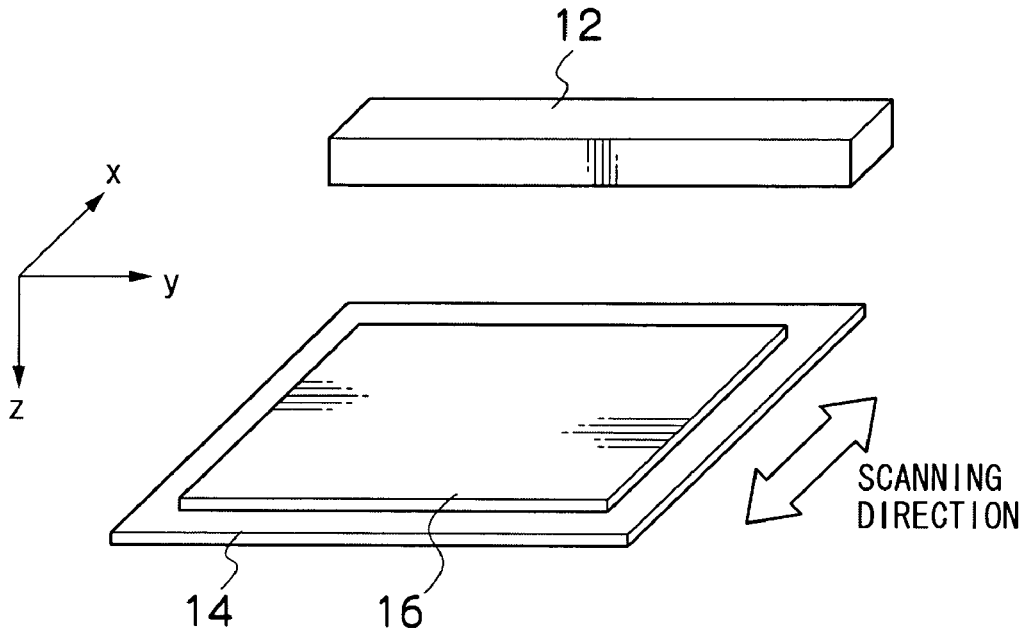
FIG. 8 is a perspective view illustrating a liquid coating device of a second embodiment of the present invention.
Figure 9:
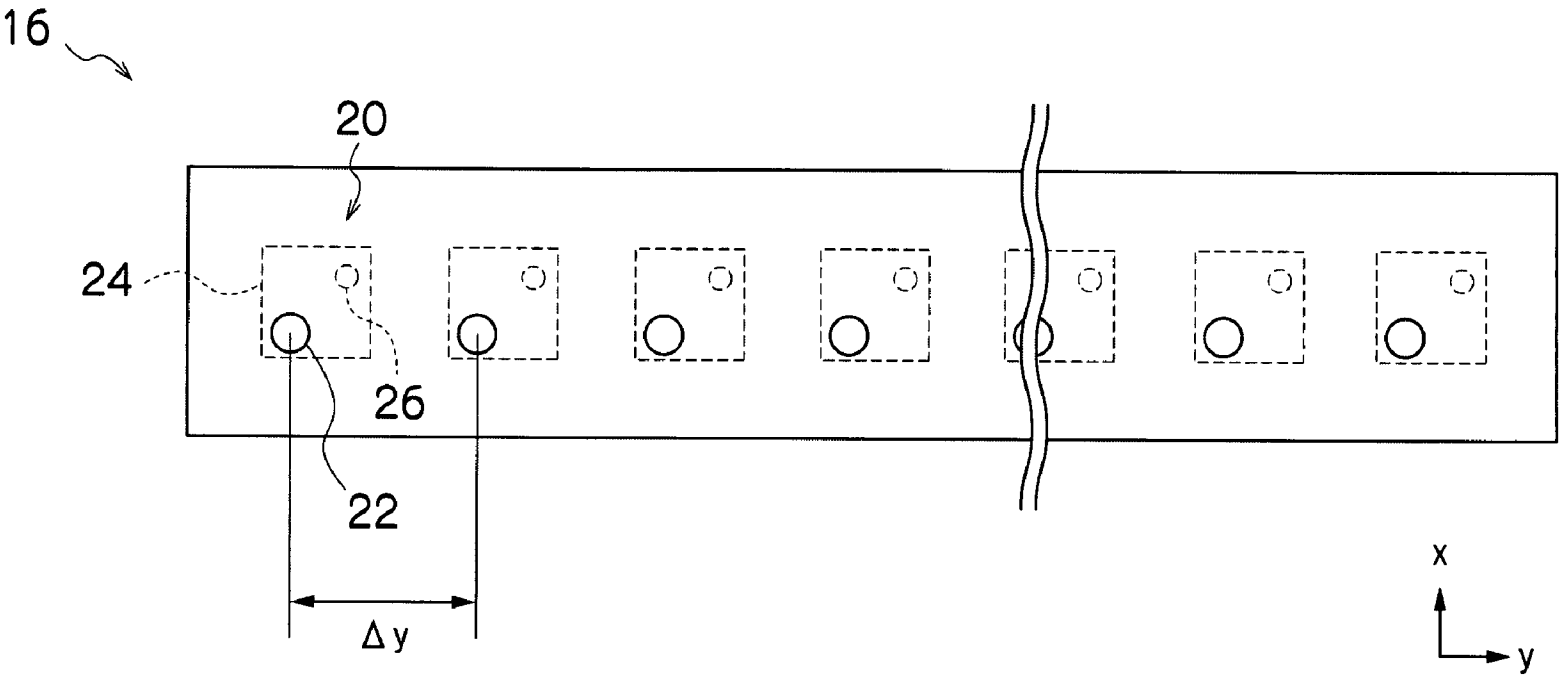
FIG. 9 is a plan view illustrating a plane formed by nozzles of the recording head 12 of the second embodiment of the present invention.

FIG. 8 is a perspective view illustrating a liquid coating device of a second embodiment of the present invention. FIG. 9 is a plan view illustrating a plane formed by nozzles of the recording head 12 of the present embodiment.

As illustrated in FIG. 8, the coating liquid device (ink jet recording device) 10 of the present embodiment includes an ink jet head (recording head) 12 and a support plate 14.

The recording head 12 is a line-type recording head in which nozzles 20 are arranged side by side over the entire width in the y direction of a substrate 110.

A substrate 16 that is an object of applying a liquid with the recording head 12 is placed on the support plate 14. The support plate 14 is supported in such a manner that a constant clearance between the support plate 14 and the recording head 12 is maintained, and the scanning therebetween in the main scanning direction (x direction in FIG. 1) can be carried out.

The support plate 14 is scanned in the x direction and droplets are ejected from the recording head 12 in each scanning position, thereby making it possible to apply the liquid on the entire surface of the imaging region of the substrate 16.

Figure 10:
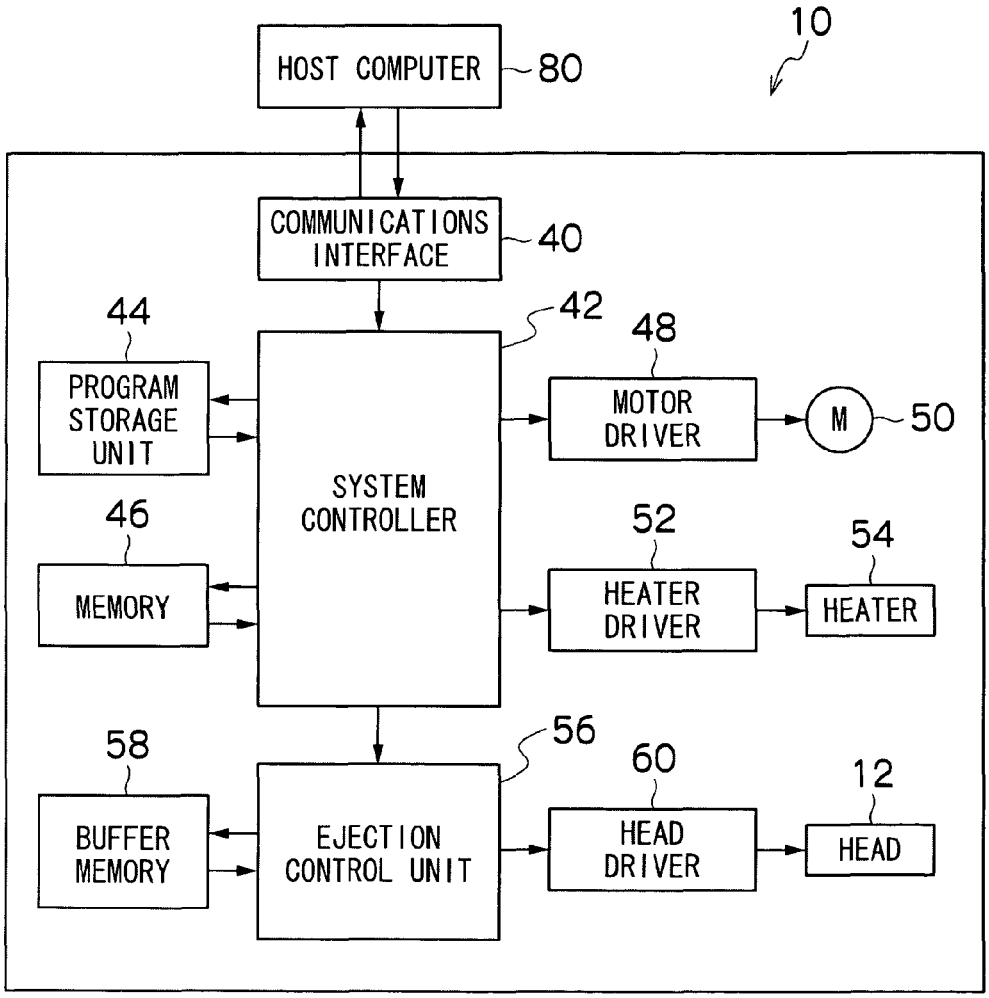
FIG. 10 is a block diagram illustrating a control system of the liquid coating device of the second embodiment of the present invention.

FIG. 10 is a block diagram illustrating a control system of the liquid coating device of the present embodiment.

As illustrated in FIG. 10, the liquid coating device 10 of the present embodiment is further provided with a motor driver 48 and a motor 50.

The motor 50 serves to ensure relative scanning of the recording head 12 and the support plate 14 illustrated in FIG. 8. The motor driver 48 drives the motor 50 according to a control signal from the system controller 42.

In the example illustrated in FIG. 8, a droplet is ejected from the recording head 12 for each scanning position of the recording head 12, thereby making it possible to apply the liquid on the entire surface of the imaging region of the substrate 16.

FIGS. 11 to 19 are perspective views illustrating other embodiments of the liquid coating device.

Figure 11:
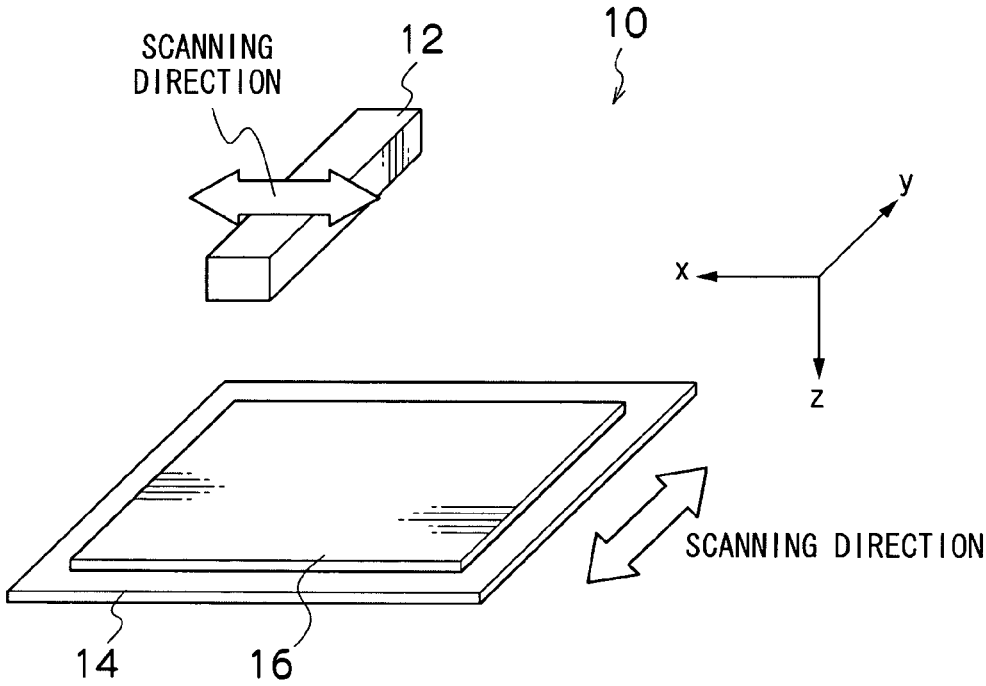
FIG. 11 is a perspective view illustrating another embodiment of the liquid coating device.

The liquid coating device 10 illustrated in FIG. 11 is configured so that the recording head 12 scans (moves) in the x direction and the support plate 14 scans in the y direction.

Figure 12:
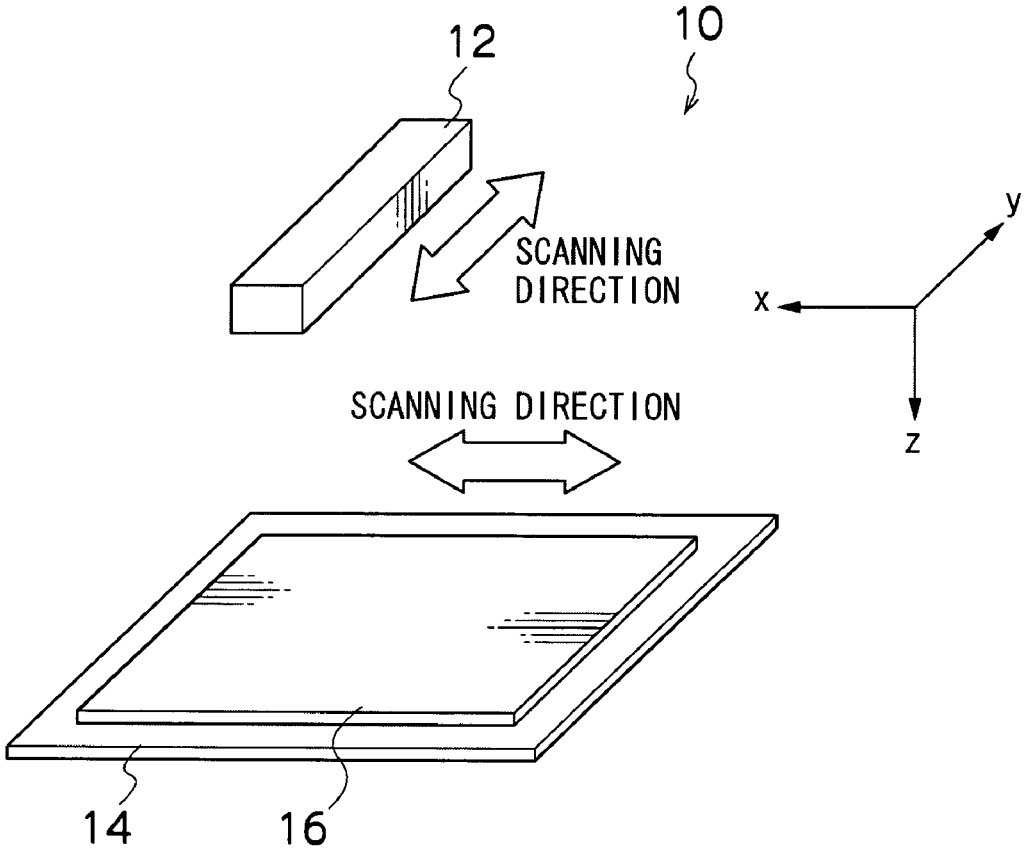
FIG. 12 is a perspective view illustrating another embodiment of the liquid coating device.

The liquid coating device 10 illustrated in FIG. 12 is configured so that the recording head 12 scans in the y direction and the support plate 14 scans in the x direction.

Figure 13:
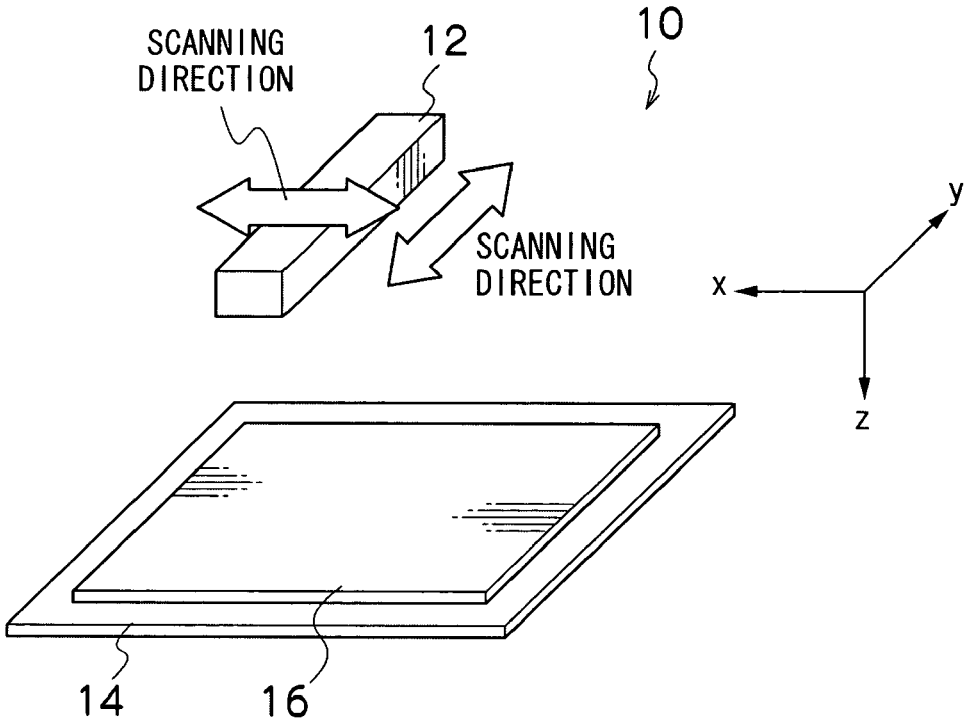
FIG. 13 is a perspective view illustrating another embodiment of the liquid coating device.

The liquid coating device 10 illustrated in FIG. 13 is configured so that the recording head 12 scans in the x direction and y direction.

Figure 14:
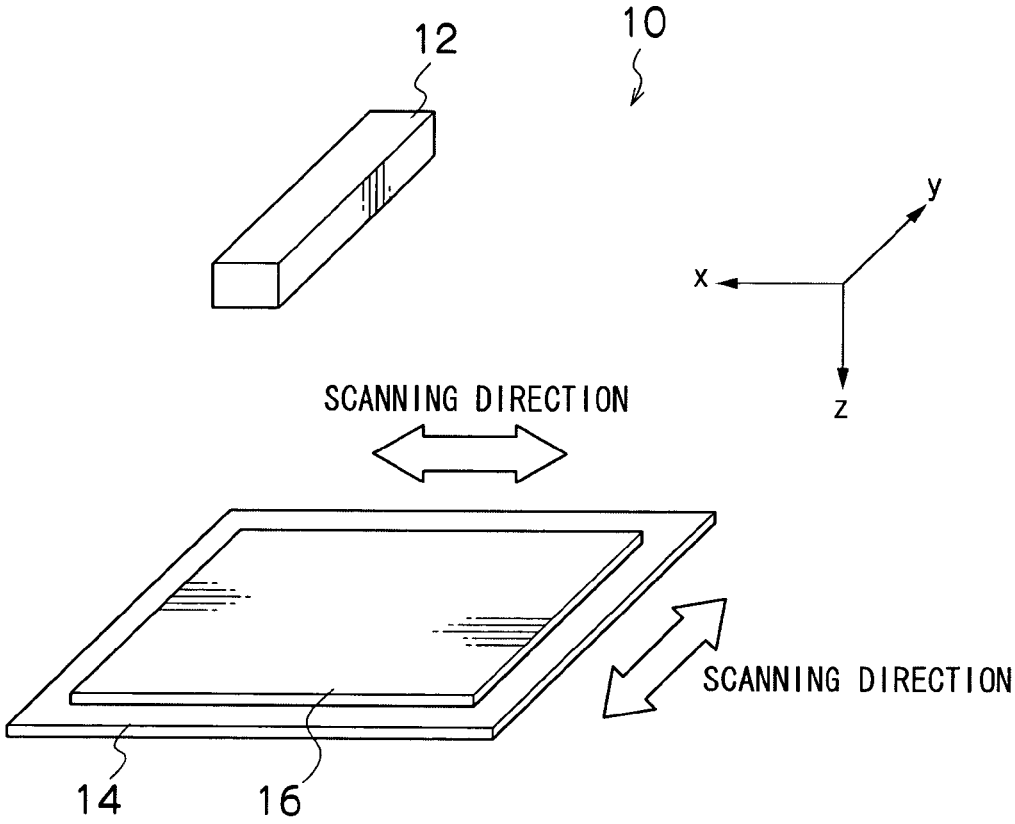
FIG. 14 is a perspective view illustrating another embodiment of the liquid coating device.

The liquid coating device 10 illustrated in FIG. 14 is configured so that the support plate 14 scans in the x direction and y direction.

Figure 15:
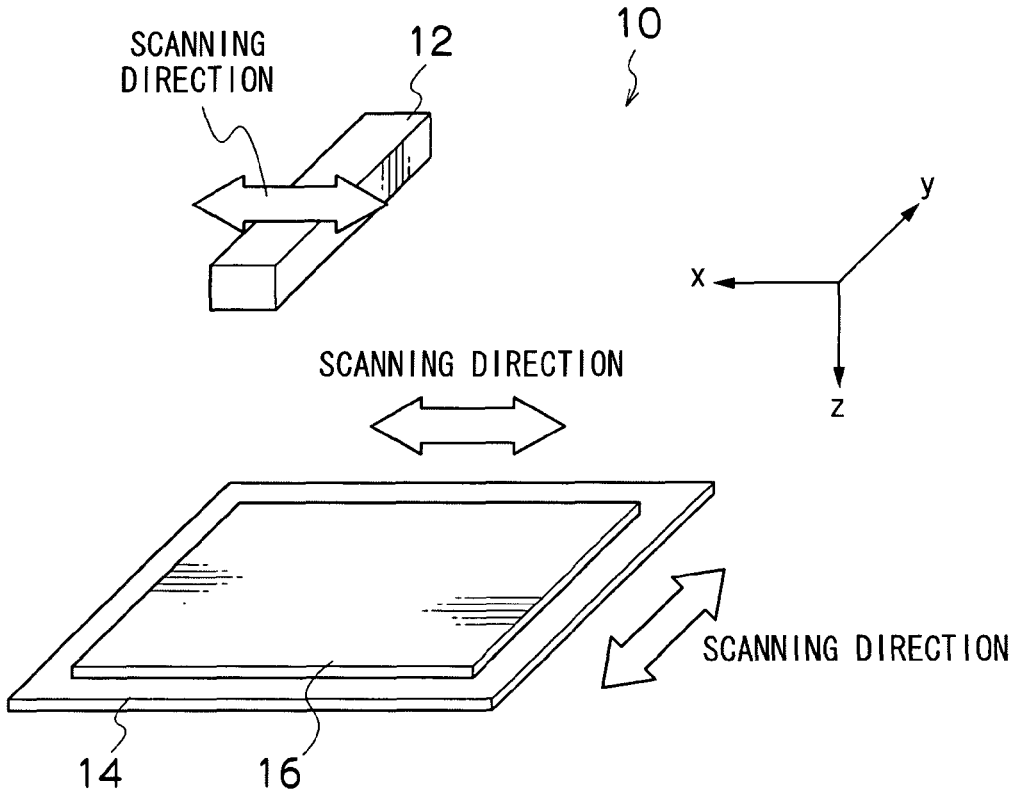
FIG. 15 is a perspective view illustrating another embodiment of the liquid coating device.

The liquid coating device 10 illustrated in FIG. 15 is configured so that the recording head 12 scans in the x direction and the support plate 14 scans in the x direction and y direction.

Figure 16:
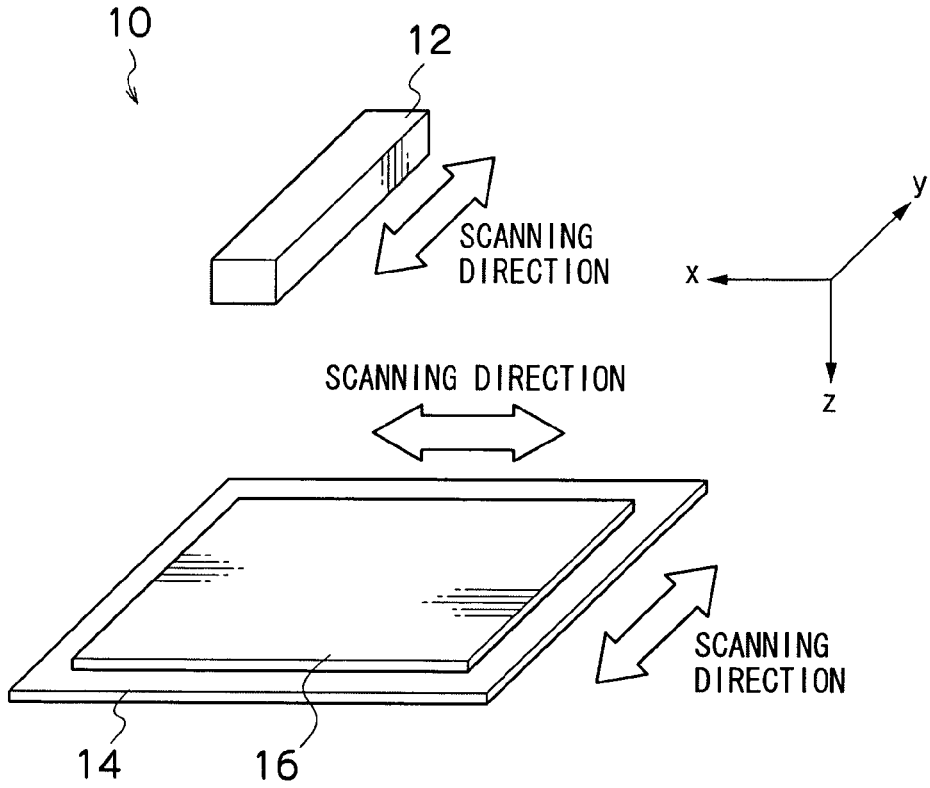
FIG. 16 is a perspective view illustrating another embodiment of the liquid coating device.

The liquid coating device 10 illustrated in FIG. 16 is configured so that the recording head 12 scans in the y direction and the support plate 14 scans in the x direction and y direction.

Figure 17:
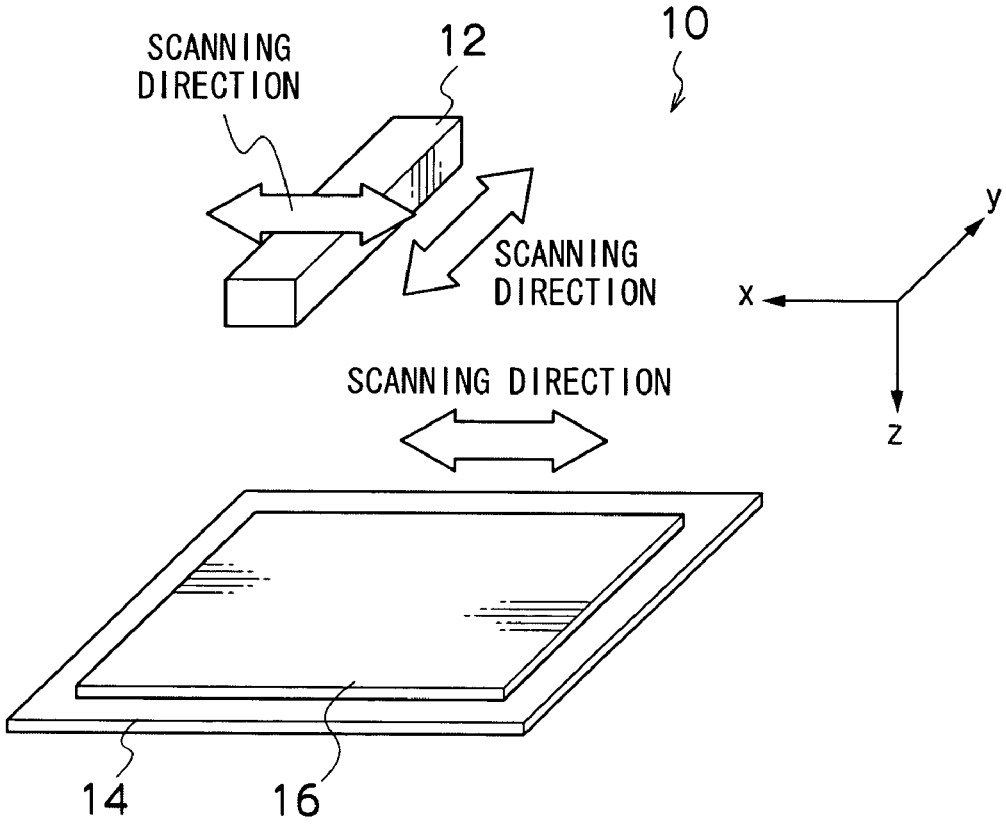
FIG. 17 is a perspective view illustrating another embodiment of the liquid coating device.

The liquid coating device 10 illustrated in FIG. 17 is configured so that the recording head 12 scans in the x direction and y direction and the support plate 14 scans in the x direction.

Figure 18:
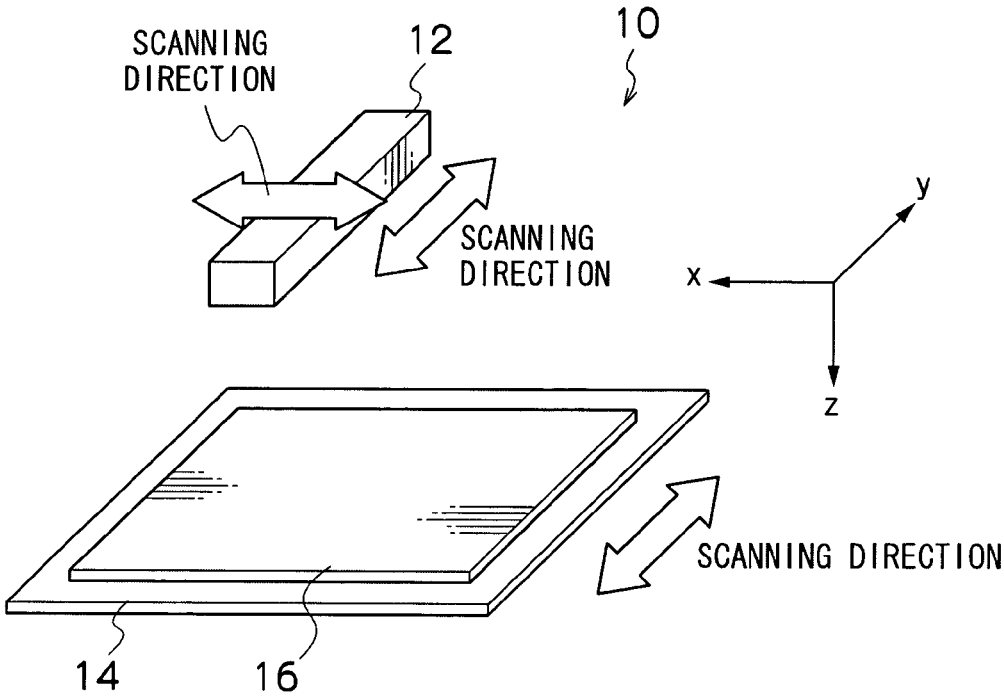
FIG. 18 is a perspective view illustrating another embodiment of the liquid coating device.

The liquid coating device 10 illustrated in FIG. 18 is configured so that the recording head 12 scans in the x direction and y direction and the support plate 14 scans in the y direction.

Figure 19:
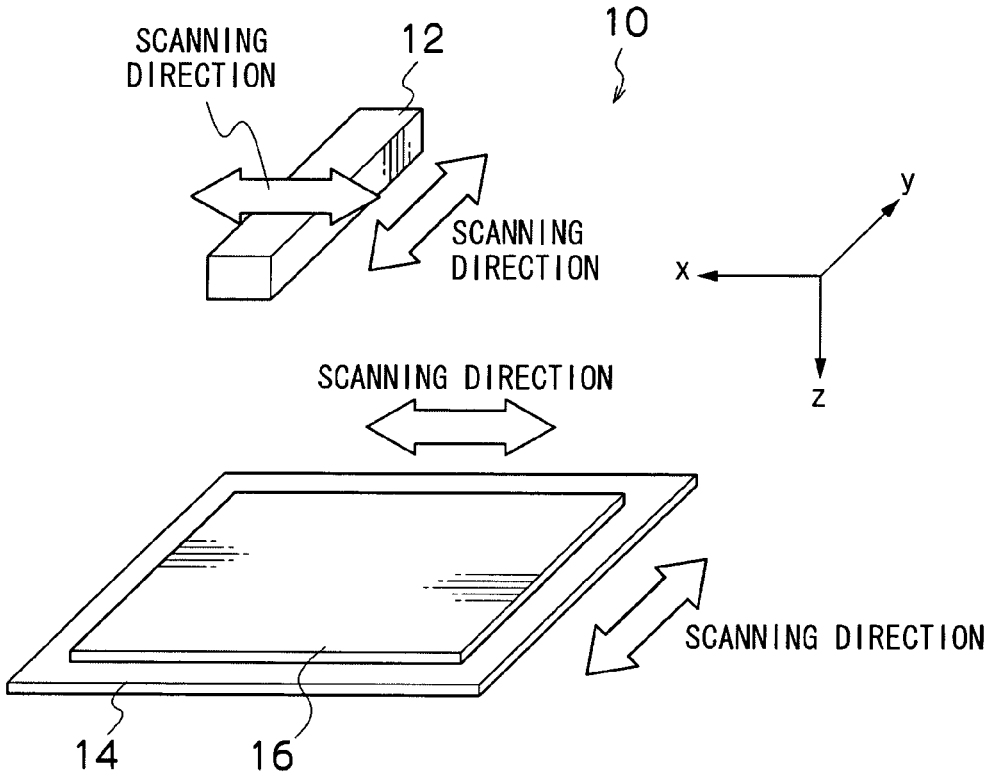
FIG. 19 is a perspective view illustrating another embodiment of the liquid coating device.

The liquid coating device 10 illustrated in FIG. 19 is configured so that the recording head 12 scans in the x direction and y direction and the support plate 14 scans in the x direction and y direction.

In the examples illustrated in FIGS. 11 to 19, at least one of the recording head 12 and the substrate 16 is driven and a droplet is ejected from the recording head 12 for each scanning position, thereby making it possible to apply the liquid on the entire surface of the imaging region of the substrate 16.

As in the examples illustrated in FIGS. 8 to 19, when at least one of the recording head 12 and the substrate 16 is movable, it is desirable that the number of scans of the imaging region when the liquid is applied on the substrate 16 should be one. The entire substrate 16 may be also scanned a plurality of times.

It is also preferred that the nozzle pitches Δx and Δy of the recording head 12 satisfy any one of conditions [1] and [2] below.

[1] A dot pitch in the main scanning direction (x direction) (dot pitch ϕ satisfying the condition represented by Formula (3) above) is equal to the nozzle pitch Δx in the main scanning direction of the recording head 12.

[2] A dot pitch in the sub-scanning direction (y direction) (dot pitch ϕ satisfying the condition represented by Formula (3) above) is equal to the nozzle pitch Δy in the sub-scanning direction of the recording head 12.

The recording head 12, as referred to herein, means the entire configuration that ejects the liquid. The nozzle pitch, as referred to herein, means the nozzle spacing when ejection positions at which the nozzles eject the liquid are virtually arranged on a straight line that is drawn in the relative movement direction of the substrate 16 and the recording head 12.

In a line-type recording head 12 in which the relative movement direction of the recording head 12 and the substrate 16 is one direction and the nozzles 20 are arranged side by side over the entire width in the y direction of the substrate 110, as illustrated in FIG. 8, it is preferred that the nozzle pitch Δx in the main scanning direction of the recording head 12 and the nozzle pitch Δy in the sub-scanning direction be equal to the dot pitch ϕ satisfying the condition represented by Formula (3) above.

As illustrated in FIGS. 11 to 19, when there are two or more relative movement directions of the recording head 12 and the substrate 16, it is preferred that the nozzle pitch Δx in the main scanning direction of the recording head 12 and the nozzle pitch Δy in the sub-scanning direction be integral multiples (positive integral multiples) of the dot pitch ϕ satisfying the condition represented by Formula (3) above. With the above-described configuration of nozzle pitches of the recording head 12, the movement amount of the recording head 12 and the support plate 14 during driving becomes discrete and the drive system can be simplified.

When there are two or more relative movement directions of the recording head 12 and the substrate 16, it is more preferred that the nozzle pitch Δx in the main scanning direction of the recording head 12 and the nozzle pitch Δy in the sub-scanning direction be equal to the dot pitch ϕ satisfying the condition represented by Formula (3) above. In this case, the movement amount during driving becomes constant and the drive system can be greatly simplified.

Instead of determining the nozzle pitches of the recording head 12 on the basis of the condition relating to the dot pitch ϕ, it is also possible, for example, to perform scanning with an inclined recording head 12 so that the nozzle pitch becomes a positive integral multiple of the dot pitch ϕ.

Embodiment of Radiation Detector

An embodiment of a radiation detector produced using the liquid coating device 10 of the present embodiment will be described below.

The radiation detector of the present embodiment is suitable for X ray pickup devices or the like, includes an electrostatic recording unit having a photoconductive layer that becomes conductive when irradiated with radiation, receives radiation carrying image information, records the image information, and outputs an image signal representing the recorded image information.

Examples of radiation detectors include a radiation detection substrate 500 of the so-called optical reading system in which reading is performed using a semiconductor material that generates an electric charge under light illumination and a radiation detector 400 of a system (referred to hereinbelow as "TFT system") in which electric charges generated by irradiation with radiation are accumulated and the accumulated electric charges are read out by ON-OFF switching of an electric switch such as a thin-film transistor (TFT) by one pixel.

Configuration of Radiation Detector 400 of TFT System

Figure 20A:
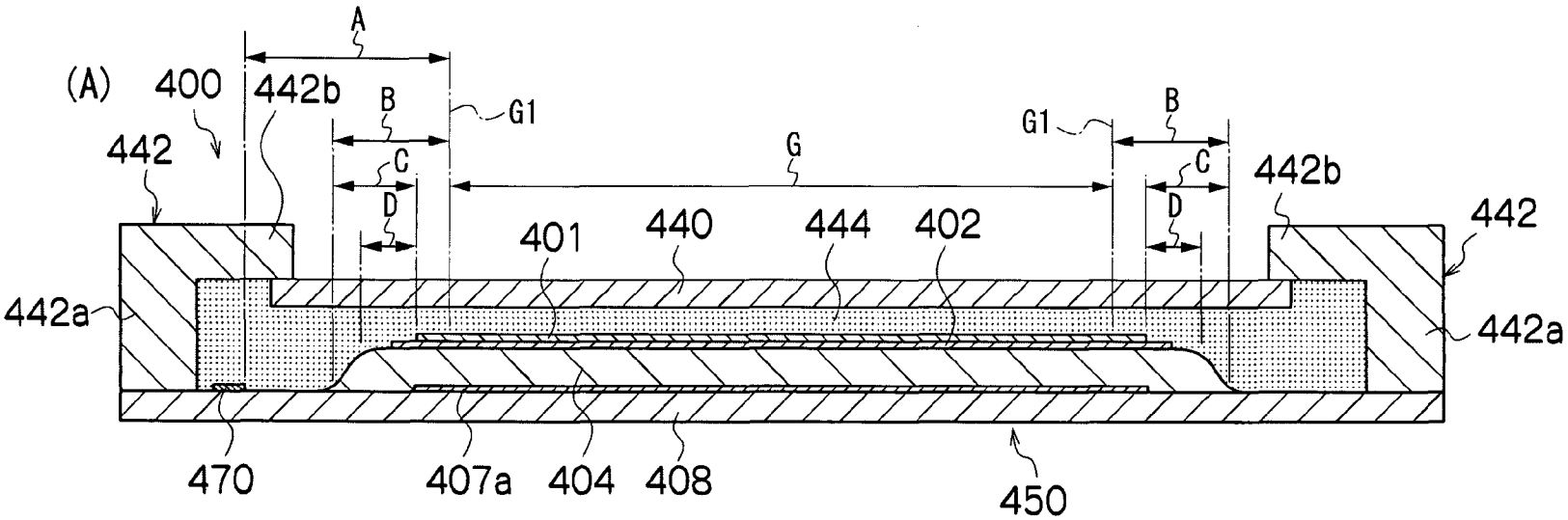
FIGS. 20A and 20B are schematic diagrams illustrating the entire configuration of the radiation detector of a TFT system.
Figure 21:
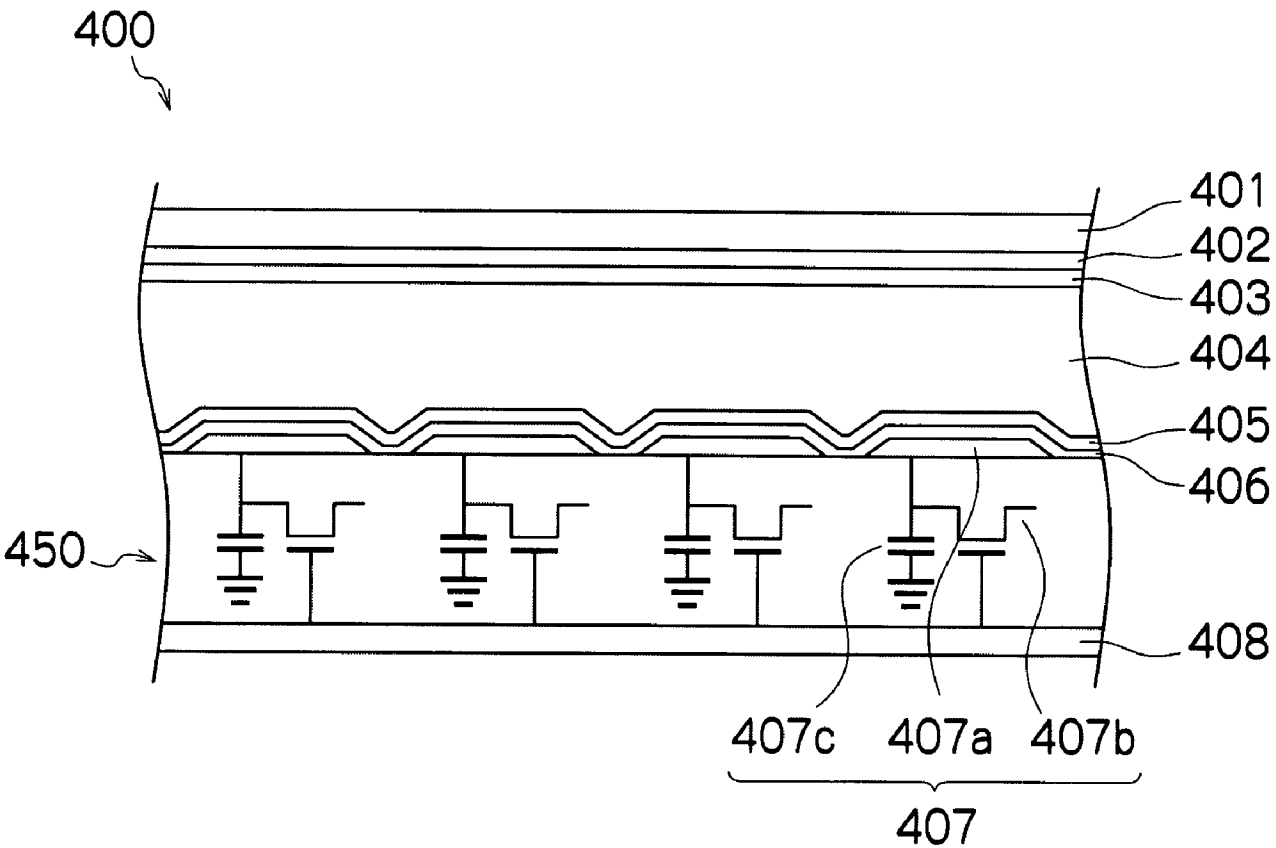
FIG. 21 is a schematic structural diagram illustrating main components of the radiation detector of a TFT system.

A configuration of the radiation detector 400 of a TFT system will be explained below. FIG. 20A is a schematic diagram illustrating the entire configuration of the radiation detector 400 of a TFT system. FIG. 21 illustrates principal configuration of the radiation detector 400 of a TFT system and illustrates components laminated on a glass substrate.

The radiation detector 400 of a TFT system of the present embodiment is provided with a photoconductive layer 404 that demonstrates an electromagnetic wave conductivity as a charge conversion layer generating electric charges under irradiation with X rays as an example of radiation carrying image information, as illustrated in FIG. 20A and FIG. 21. A noncrystalline (amorphous) material that has a high dark resistance, demonstrates good electromagnetic wave conductivity in response to X ray irradiation, and can be formed as a film of a large surface area at a low temperature by a vacuum vapor deposition method is preferred as the photoconductive layer 404.

For example, an amorphous Se (a-Se) film is used as the noncrystalline (amorphous) material. Furthermore, materials obtained by doping amorphous Se with As, Sb, and Ge have excellent thermal stability and are preferred for the photoconductive layer 404.

A bias electrode 401 that applies a bias voltage to the photoconductive layer 404 is formed as a first electrode that transmits radiation carrying image information on the photoconductive layer 404. The bias electrode 401 is formed, for example, from gold (Au). The radiation transmitted by the bias electrode 401 falls on the photoconductive layer 404.

A plurality of charge collecting electrodes 407*a* are formed as second electrodes collecting electric charges generated by the photoconductive layer 404 on the side opposite the side on which the bias electrode 401 is provided with respect to the photoconductive layer 404, that is, below the photoconductive layer 404. As illustrated in FIG. 21, the charge collecting electrodes 407*a* are connected to respective charge accumulating capacitors 407*c* and switch elements 407*b*. The charge collecting electrodes 407*a* are also provided on the glass substrate 408.

Furthermore, as illustrated in FIG. 20A and FIG. 21, a hole injection preventing layer 402 that has a hole blocking material is provided as an organic polymer layer between the photoconductive layer 404 and the bias electrode 401. The organic polymer layer may also serve as a charge injection blocking layer having charge selectivity. The charge injection blocking layer having charge selectivity, as referred to herein, is a layer that has a property of blocking electric charges (holes when the bias electrode 401 has a positive bias and electrons when it has a negative bias) flowing out of the bias electrode 401, which is in contact with the charge injection blocking layer, and transmitting electric charges flowing to the bias electrode 401.

Thus, a hole injection blocking layer that blocks the injection of holes, while serving as a conductor with respect to electrons, or an electron injection blocking layer that blocks the injection of electrons, while being a conductor with respect to holes, can be used as the charge injection blocking layer. In the present embodiment, because the bias electrode 401 is a positive electrode, the hole injection blocking layer 402 is provided as the organic polymer layer.

A film in which a hole blocking material is mixed with an insulating polymer such as a polycarbonate, polystyrene, a polyimide, and a polycycloolefin can be advantageously used as the hole injection blocking layer 402.

At least one kind of a hole blocking material contained in the hole injection blocking layer 402 is desirably of at least one kind selected from carbon clusters and derivatives thereof. The carbon cluster is desirably of at least one kind selected from fullerene C60, fullerene C70, fullerene oxide, and derivatives thereof.

As illustrated in FIG. 21, an electron injection blocking layer 406 is provided between the photoconductive layer 404 and the charge collecting electrode 407*a*.

Crystallization blocking layers 403 and 405 are provided between the hole injection blocking layer 402 and the photoconductive layer 404 and between the electron injection blocking layer 406 and the photoconductive layer 404, respectively. GeSe, $GeSe_2$, $Sb_2Se_3$, a-$As_2Se_3$, Se—As, Se—Ge, and Se—Sb compounds can be used for the crystallization blocking layers 403 and 405.

An active matrix layer 407 is configured by the charge collecting electrodes 407*a*, switch elements 407*b*, and charge accumulation capacitors 407*c*. An active matrix substrate 450 is configured by the glass substrate 408 and active matrix layer 407.

Figure 22:
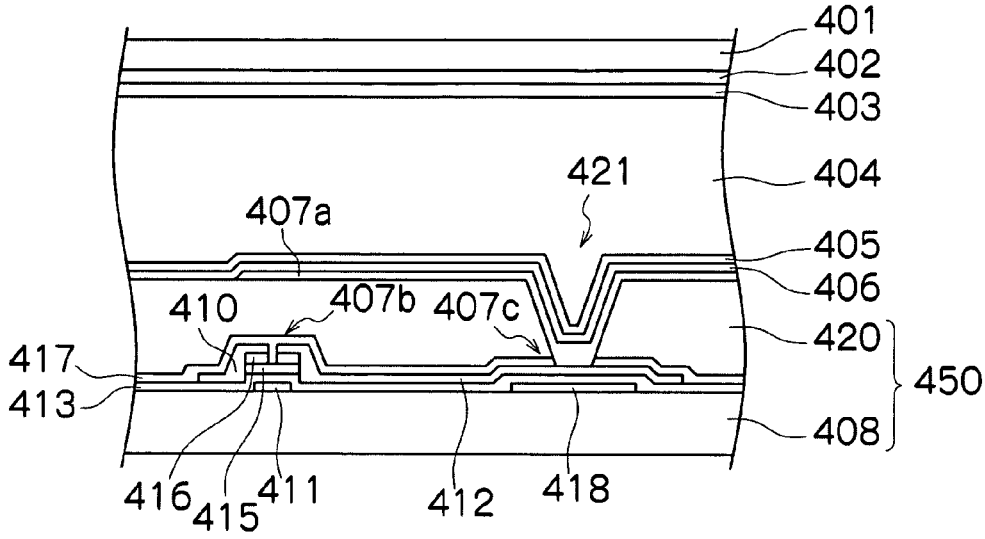
FIG. 22 is a cross-sectional view illustrating a structure of a one-pixel unit of the radiation detector of a TFT system.
Figure 23:
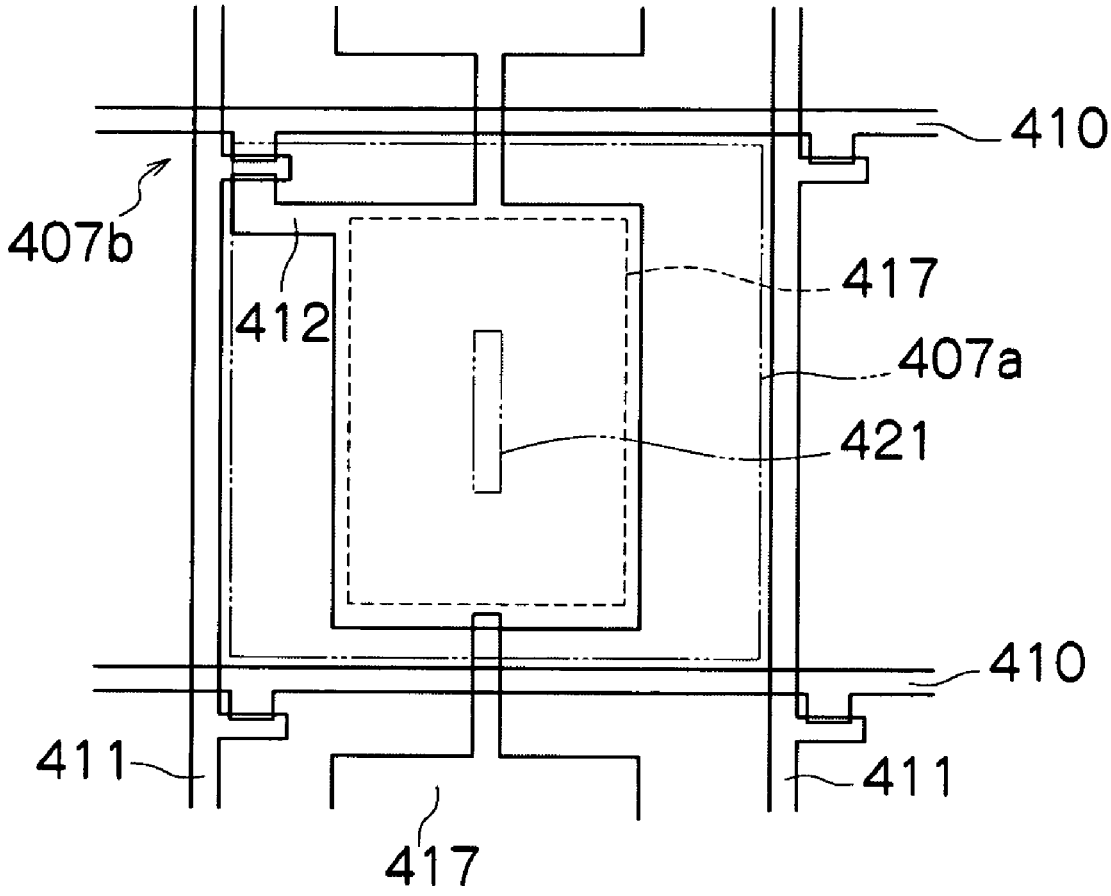
FIG. 23 is a plan view illustrating a structure of a one-pixel unit of the radiation detector of a TFT system.

FIG. 22 is a cross-sectional view illustrating the structure of a one-pixel unit of the radiation detector 400. FIG. 23 is a plan view thereof. One pixel illustrated in FIG. 22 and FIG. 23 has a size of about 0.1 mm×0.1 mm to 0.3 mm×0.3 mm. In the entire radiation detector, the pixels are arranged as a matrix including about 500×500 to 3000×3000 pixels.

As illustrated in FIG. 22, the active matrix substrate 450 has the glass substrate 408, gate electrodes 411, charge accumulating capacitor electrodes (referred to hereinbelow as Cs electrodes) 418, a gate insulating film 413, drain electrodes 412, a channel layer 415, collector electrodes 416, source electrodes 410, an insulating protective film 417, an interlayer insulating film 420, and charge collecting electrodes 407*a*.

The switch element 407*b* composed of a thin-film transistor (TFT) is configured by the gate electrode 411, gate insulating film 413, source electrode 410, drain electrode 412, channel layer 415, and contact electrode 416. The charge accumulation capacitor 407*c* is configured by the Cs electrode 418, gate insulating film 413, and drain electrode 412.

The glass substrate 408 is a support substrate. For example, an alkali-free glass substrate (for example, #1737 manufactured by Corning Co.) can be used as the glass substrate 408. The gate electrodes 411 and source electrodes 410 are electrode wirings arranged in a grid-like configuration, as illustrated in FIG. 23, and the switch element 407*b* composed of a thin-film transistor is formed in the intersection points of the electrodes.

A source and a drain of the switch element 407*b* are connected to the source electrode 410 and drain electrode 412, respectively. The source electrode 410 is provided with a linear portion as a signal line and an extending portion for configuring the switch element 407*b*. The drain electrode 412 is provided so as to link the switch element 407*b* and the charge accumulating capacitor 407*c*.

A take-out electrode 470 that takes out the electric charge collected at the charge collecting electrode 407*a* is connected to the source electrode 410 for acquiring image information. The take-out electrode 470 is provided at the glass substrate 408 and disposed outside the photoconductive layer 404.

The gate insulating film 413 is composed of SiNx or SiOx. The gate insulating film 413 is provided to cover the gate electrode 411 and Cs electrode 418. A zone of the gate insulating film positioned above the gate electrode 411 acts as a gate insulating film in the switch element 407*b*, and the zone positioned above the Cs electrode 418 acts as a dielectric layer in the charge accumulating capacitor 407*c*. In other words, the charge accumulating capacitor 407*c* is formed by a superposition region of the drain electrode 412 and the Cs electrode 418 formed in the same layer as the gate electrode 411. Not only SiNx and SiOx, but also an anodization film obtained by anodization of the gate electrode 411 and Cs electrode 418 can be used as the gate insulating film 413.

Furthermore, the channel layer (i layer) 415 is a channel portion of the switch element 407*b* and serves as a current channel linking the source electrode 410 and the drain electrode 412. The contact electrode (n+ layer) 416 serves as a contact of the source electrode 410 and the drain electrode 412.

The insulating protective film 417 is formed on the source electrode 410 and the drain electrode 412, that is, on the glass substrate 408 over almost the entire surface (almost the entire region). As a result, the drain electrode 412 and source electrode 410 are protected and also electrically insulated and separated. Furthermore, the insulating protective film 417 has a contact hole 421 in a predetermined position thereof, that is, in a zone positioned on a portion facing the Cs electrode 418 in the drain electrode 412.

The charge collecting electrode 407*a* is configured by an amorphous transparent conductive oxide film. The charge collecting electrode 407*a* is formed to fill the contact hole 421 and laminated on the source electrode 410 and the drain electrode 412. The charge collecting electrode 407*a* and the photoconductive layer 404 are electrically connected so that the electric charges generated in the photoconductive layer 404 can be collected at the charge collecting electrode 407*a*.

The charge collecting electrode 407*a* will be described below in greater detail. The charge collecting electrode 407*a* used in the present embodiment is configured by an amorphous transparent conductive oxide film. Materials having an oxide of indium and tin (ITO: Indium-Tin-Oxide), an oxide of indium and zinc (IZO: Indium-Zinc-Oxide), or an oxide of indium and germanium (IGO Indium-Germanium-Oxide) as a basis composition can be used as the amorphous transparent conductive oxide film.

A variety of metal films and conductive oxide films have been used as the charge collecting electrode 407*a*, but transparent conductive oxide films such as ITO (Indium-Tin-Oxide) are used most often for the following reasons. When an incident X ray dose in the radiation detector 400 is high, unnecessary electric charges are sometimes trapped in a semiconductor film (or close to an interface of the semiconductor film and an adjacent layer).

These residual charges are stored for a long time or transferred over a long time. The resultant problem is that an X ray detection characteristic during subsequent image detection is degraded or a residual image (latent image) is developed. Accordingly, Japanese Patent Application Publication No. 9-9153 (corresponding U.S. Pat. No. 5,563,421) discloses a method by which when residual charges are generated in the photoconductive layer 404, the residual charges are excited and removed by light irradiation from the outside of the photoconductive layer 404. In this case, in order to perform light irradiation with good efficiency from below the photoconductive layer 404 (side of the charge collecting electrode 407*a*), it is necessary that the charge collecting electrode 407*a* be transparent to the irradiation light.

It is desirable that the charge collecting electrode 407*a* be formed so as to cover the switch element 407*b* in order to increase a surface area filling ratio (filling factor) of the charge collecting electrode 407*a* or shield the switch element 407*b*. However, if the charge collecting electrode 407*a* is not transparent, the switch element 407*b* cannot be observed after the charge collecting electrode 407*a* has been formed.

For example, in the case the characteristics of the switch element 407*b* are inspected after the charge collecting electrode 407*a* has been formed, where the switch element 407*b* is covered with the charge collecting electrode 407*a* that is not transparent, when property deterioration of the switch element 407*b* is found, observations under an optical microscope or the like cannot be performed to clarify the reasons for such property deterioration. Therefore, it is desirable that the charge collecting electrode 407*a* be transparent, thereby making it possible to observe easily the switch element 407*b* even after the charge collecting electrode 407*a* has been formed.

The interlayer insulating film 420 is composed of a photosensitive acrylic resin and serves for electric insulation and separation of the switch element 407*b*. A through contact hole 421 is formed in the interlayer insulating film 420, and the charge collecting electrode 407*a* is connected to the drain electrode 412. As illustrated in FIG. 22, the contact hole 421 is formed to have an inverse tapered shape. A high-voltage power source (not illustrated in the figure) is connected between the bias electrode 401 and the Cs electrode 418.

The configuration covering the photoconductive layer 404 will be explained below. As illustrated in FIG. 20A, a cover glass 440 as an example of a cover member that covers the bias electrode 401 is provided above the bias electrode 401.

A protective member 442 to which the cover glass 440 is bonded is provided on the glass substrate 408.

The protective member 442 is formed to have a box-like shape that surrounds the photoconductive layer 404 and is open as a whole at the top and bottom.

The protective member 442 is formed to have an L-like cross section and has a side wall 442*a* provided in a vertical condition on the outer circumferential portion of the glass substrate 408 and a flange portion 442*b* that protrudes from the upper portion of the side wall 442*a* toward the upper side of the central portion of the glass substrate 408.

An upper surface of the outer circumferential portion of the cover glass 440 is joined to a lower surface (inner wall) of the flange portion 442*b* and supported by the protective member 442.

The joint portion of the protective member 442 and the cover glass 440 is disposed outside the photoconductive layer 404. Thus, the protective member 442 and the cover glass 440 are joined in a region where the photoconductive layer 404 located on the glass substrate 408 is not present, rather than above the photoconductive layer 404.

An insulating member having insulating properties is used for the protective member 442. For example, a polycarbonate, polyethylene terephthalate (PET), polymethyl(acryl)methacrylate, and polyvinyl chloride can be used as the insulating member.

The lower opening of the protective member 442 is closed by the glass substrate 408, and the upper opening is closed with the cover glass 440, thereby forming a closed space of a predetermined volume inside the protective member 442. The photoconductive layer 404 is accommodated in this closed space, and the photoconductive layer 404 is covered by the cover glass 440, glass substrate 408, and protective member 442.

The space surrounded by the cover glass 440, protective member 442, and glass substrate 408 is filled with a curable resin 444 serving as a filling member. For example, a resin curable at normal temperature, such as epoxy resin or silicone can be used as the curable resin 444.

Formation Range of Hole Injection Blocking Layer 402

A formation range of the hole injection blocking layer 402 will be explained below.

An outer edge portion of the hole injection blocking layer 402 serving as an organic polymer layer, that is, a circumferential edge serving as a boundary with other layers is located in a predetermined position. As a result, the hole injection blocking layer 402 is formed within a predetermined range and has a configuration covering the predetermined range.

In the configuration of the present embodiment, the outer edge portion of the hole injection blocking layer 402 is positioned between a region end G1 of an image information acquisition region G where image information is acquired and the take-out electrode 470, within a region irradiated with radiation carrying the image information. A range represented by arrow A in FIG. 20A is between the region end G1 of an image information acquisition region G and the take-out electrode 470.

In the preferred configuration, the outer edge portion of the hole injection blocking layer 402 of the present embodiment is located outside the image information acquisition region G and within a region having a film thickness equal to or greater than 10% the average film thickness of the flat portion of the photoconductive layer 404. The average film thickness of the flat portion of the photoconductive layer 404 is determined by measuring a film thickness in any nine points within a region of the image information acquisition region G of the photoconductive layer 404 and finding an average film thickness for these nine points. The film thickness is measured by observing the cross section of the film under a microscope with a magnification factor of 100.

A range represented by arrow B in FIG. 20A is outside the image information acquisition region G and within a region having a film thickness equal to or greater than 10% the average film thickness of the flat portion of the photoconductive layer 404.

In even more preferred configuration, the outer edge portion of the hole injection blocking layer 402 of the present embodiment is located outside the bias electrode 401 and within a region having a film thickness equal to or greater than 10% the average film thickness of the flat portion of the photoconductive layer 404.

A range represented by arrow C in FIG. 20A is outside the bias electrode 401 and within a region having a film thickness equal to or greater than 10% the average film thickness of the flat portion of the photoconductive layer 404.

In even more preferred configuration, the outer edge portion of the hole injection blocking layer 402 of the present embodiment is located outside the bias electrode 401 and within a region in which a gradient of an end portion bevel of the photoconductive layer 404 is equal to or less than 50%.

Figure 20B:
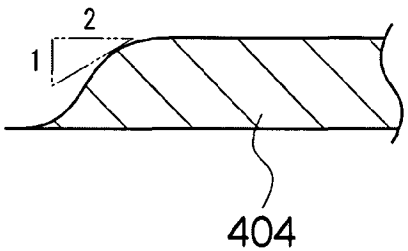

The outer edge portion of the hole injection blocking layer 402 is positioned within a region with a gradient of equal to or less than 50% in the end portion bevel of the photoconductive layer 404 in which the gradient gradually increases from the flat portion to the outer edge, that is, within a range in which the gradient is more gradual than a gradient of 50%. The gradient of 50% is a gradient formed by an inclined side in a rectangular triangle configured by a side along the film thickness direction of the photoconductive layer 404, a side perpendicular to this side, and the inclined side, as illustrated in FIG. 20B, in which where the length of the side along the film thickness direction of the photoconductive layer 404 is taken as 1, the length of the side perpendicular to this side is 2. The gradient is measured by observing the cross section under a microscope with a magnification of 100.

A range represented by arrow D in FIG. 20A is outside the bias electrode 401 and within a region in which the gradient of the end portion bevel of the photoconductive layer 404 is equal to or less than 50%.

The photoconductive layer 404 is formed in a region wider than the bias electrode 401. Furthermore, the charge collecting electrode 407*a* is formed in a region wider than the image information acquisition region G.

The outer edge portion of the hole injection blocking layer 402 of the present embodiment may be positioned outside the image information acquisition region G and in the region of the photoconductive layer 404.

Operation Principle of Radiation Detector of TFT System

The operation principle of the radiation detector 400 of a TFT system will be described below. Where the photoconductive layer 404 is irradiated with X rays, electric charges (electron-hole pairs) are generated inside the photoconductive layer 404. In a state in which a voltage is applied between the bias electrode 401 and the Cs electrode 418, that is, in a state in which a voltage is applied to the photoconductive layer 404 via the bias electrode 401 and the Cs electrode 418, a structure is produced in which the photoconductive layer 404 and the charge accumulating capacitor 407*c* are electrically connected in serial. Therefore, the electrons generated in the photoconductive layer 404 move to the + electrode side and holes move to the − electrode side. As a result, electric charges are accumulated in the charge accumulating capacitor 407*c*.

The electric charges accumulated in the charge accumulating capacitor 407*c* can be taken out from the source electrode 410 to the outside via the take-out electrode 470 by setting the switch element 407*b* into an ON state by an input signal to the gate electrode 411. Furthermore, because the electrode wirings composed of gate electrodes 411 and source electrodes 410, switch element 407*b*, and charge accumulating capacitor 407*c* are all provided in a matrix-like configuration, image information of X rays can be obtained two dimensionally by successively scanning the signals inputted to the gate electrode 411 and detecting the signal from the source electrode 410 for each source electrode 410.

EXAMPLE 1

In Example 1, an electron injection blocking layer 406 composed of antimony sulfide and having a thickness of 2 μm was formed on an active matrix substrate 450. Then, a crystallization blocking layer 405 with a thickness of 0.15 μm was formed by vapor depositing a Se starting material containing 3% As. A photoconductive layer 404 composed of amorphous Se and having a thickness of 1000 μm was formed by vapor depositing a Se starting material containing 10 ppm Na.

A hole injection blocking layer 402 was formed as an organic polymer layer by using an ejection liquid including a hole blocking material of at least one kind selected from carbon clusters and derivatives thereof and at least one from aromatic solvents represented by General Chemical Formulas (1) and (2).

General Chemical Formula (I)

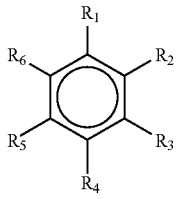

General Chemical Formula (2)

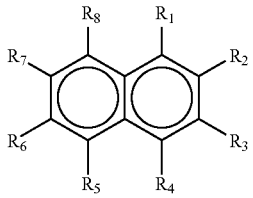

(In the General Chemical Formulas (1) and (2), $R_1$-$R_8$ represent hydrogen, a halogen, or an alkyl group).

In the present example, fullerene C60 was used as the carbon cluster. Fullerene C60 was nanom purple (C60) manufactured by Frontier Carbon Corp.

Furthermore, in the present example, the coating liquid was prepared by dissolving 1.05 wt. % polycarbonate resin (PCz) (lupilon PCz-400, manufactured by Mitsubishi Gas Chemical Co., Ltd.) and 30 wt. % (based on the PCz) fullerene C60 in o-dichlorobenzene serving as the aforementioned aromatic solvent.

Figure 24:
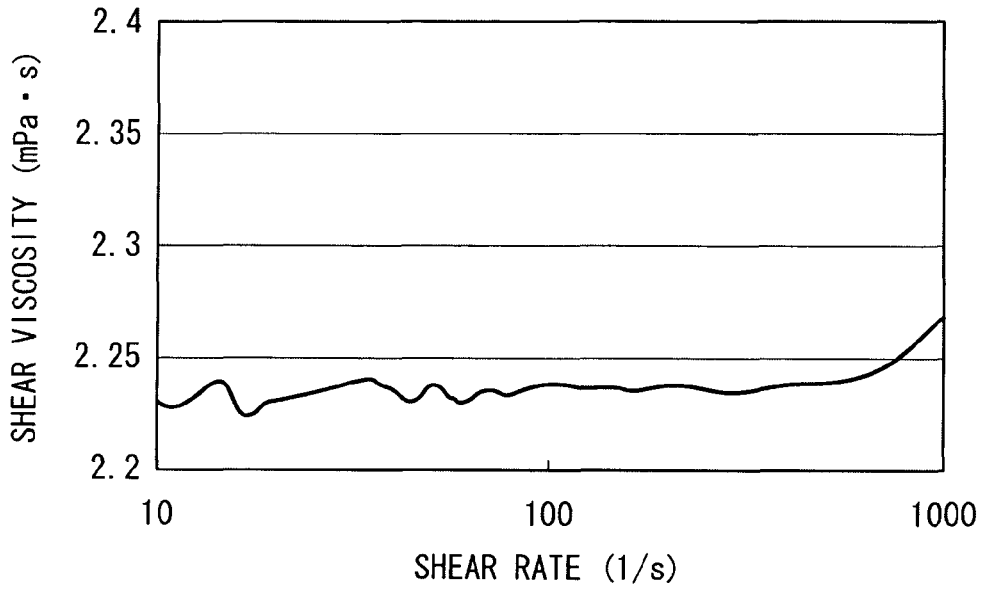
FIG. 24 is a graph illustrating the relationship between a shear rate and a shear viscosity of an ejection liquid used to form a hole injection blocking layer in the radiation detector of a TFT system.

The ejection liquid had a dilatancy property. The dilatancy property is an ability of a liquid to increase in viscosity in response to increase in a shear rate. The relationship between shear rate and shear viscosity of the ejection liquid was measured with a rheometer. The shear rate was measured twice within a range of 10 to 1000 $s^{-1}$. The average value is illustrated in FIG. 24. Because the shear viscosity increased with the increase in shear rate, it can be said that the ejection liquid has a dilatancy property.

The exponential approximate equation of the graph illustrated in FIG. 24 is $y=2.2331e^{1E-05x}$. A shear rate applied to the ejection liquid during ejection from an ink jet head is generally considered to be about $10^5$ $s^{-1}$, and a shear viscosity in this case is estimated at 6.07 mPa·s. Meanwhile, because the shear rate after landing can be taken as 0 $s^{-1}$, the shear viscosity at this time can be estimated as 2.23 mPa·s. Because viscosity decreases after landing, the liquid spreads easily and is clearly suitable for forming a uniform film.

Furthermore, a contact angle of the ejection liquid with the photoconductive layer 404 is taken to be equal to or less than 45°. In the present example, an ejection liquid was used that had a contact angle of 5° with the photoconductive layer 404.

The ejection liquid was loaded in an ink jet head SE-128 manufactured by FUJIFILM Dimatix, Inc., and ejection was carried out into a range that was wider than the image information acquisition region G and did not cover the take-out electrode 470. A solvent was evaporated in a vacuum drier and a hole injection blocking layer 402 with a thickness of 0.2 μm was obtained. Finally, an Au film was formed by vapor deposition on the inside of the end of the hole injection blocking layer 402 and the bias electrode 401 with a thickness of 0.1 μm was obtained.

In the configuration of the present example, the outer edge portion of the hole injection blocking layer 402 is positioned at a distance of 1 mm from the take-out electrode 470 on the side of the image information acquisition region G and between the take-out electrode 470 and the region end G1 of the image information acquisition region G where image information is acquired.

As a result, the image information acquisition region G of the photoconductive layer 404 is covered with the hole injection blocking layer 402, degradation of the photoconductive layer 404 such as crystallization in the image information acquisition region G can be inhibited, and endurance of the radiation detector 400 is increased. Because the hole injection blocking layer 402 does not cover the take-out electrode 470, adverse effect on conduction of the take-out electrode 470 can be prevented.

EXAMPLE 2

In the configuration of Example 2, the outer edge portion of the hole injection blocking layer 402 is positioned within 1 mm from the end of the bias electrode 401 and within a region that is outside the image information acquisition region G and has a thickness of equal to or more than 10% the average thickness of the flat portion of the photoconductive layer 404.

With the configuration of the present example, the hole injection blocking layer 402 having charge selectivity does not cover a region having a thickness less than 10% the average thickness of the flat portion of the photoconductive layer 404, that is, a region of small thickness, thereby inhibiting the occurrence of a surface discharge generated along the hole injection blocking layer 402.

EXAMPLE 3

In the configuration of Example 3, the outer edge portion of the hole injection blocking layer 402 is positioned in a location with 50% the average thickness of the flat portion of the photoconductive layer 404 and within a region that is outside the bias electrode 401 and has a thickness of equal to or more than 10% the average thickness of the flat portion of the photoconductive layer 404.

With the configuration of the present example, the hole injection blocking layer 402 covers the end portion of the bias electrode 401, thereby inhibiting a discharge breakdown caused by electric field concentration at the end portion of the bias electrode 401.

EXAMPLE 4

In the configuration of Example 4, the outer edge portion of the hole injection blocking layer 402 is positioned 2 mm outside the end of the bias electrode 401 and within a region that is outside the bias electrode 401 and in which the gradient of the end portion bevel of the photoconductive layer 404 is equal to or less than 50%.

With the configuration of the present example, because the hole injection blocking layer 402 is formed in the region in which the gradient of the end portion bevel of the photoconductive layer 404 is equal to or less than 50%, no liquid sagging occurs even when the hole injection blocking layer 402 is formed from a liquid material. Where a liquid pool is produced by sagging, crystallization of C60 occurs and a surface discharge is easily induced, but in the present example, no sagging occurs and, therefore, the surface discharge can be inhibited.

Furthermore, the hole injection blocking layer 402 may have a two-layer structure, and antimony sulfide may be laminated to a film thickness of 0.6 μm on the organic polymer layer including a fullerene. Such a configuration increases hole blocking ability.

Configuration of Radiation Detector of Optical Reading System

The present invention is also applicable to a radiation detector of an optical reading system and can be applied correspondingly to the configuration of the hole injection blocking layer 402 in the above-described radiation detector 400. Here, a radiation detection substrate 500 serving as a radiation detector of an optical reading system will be described.

Figure 25A:
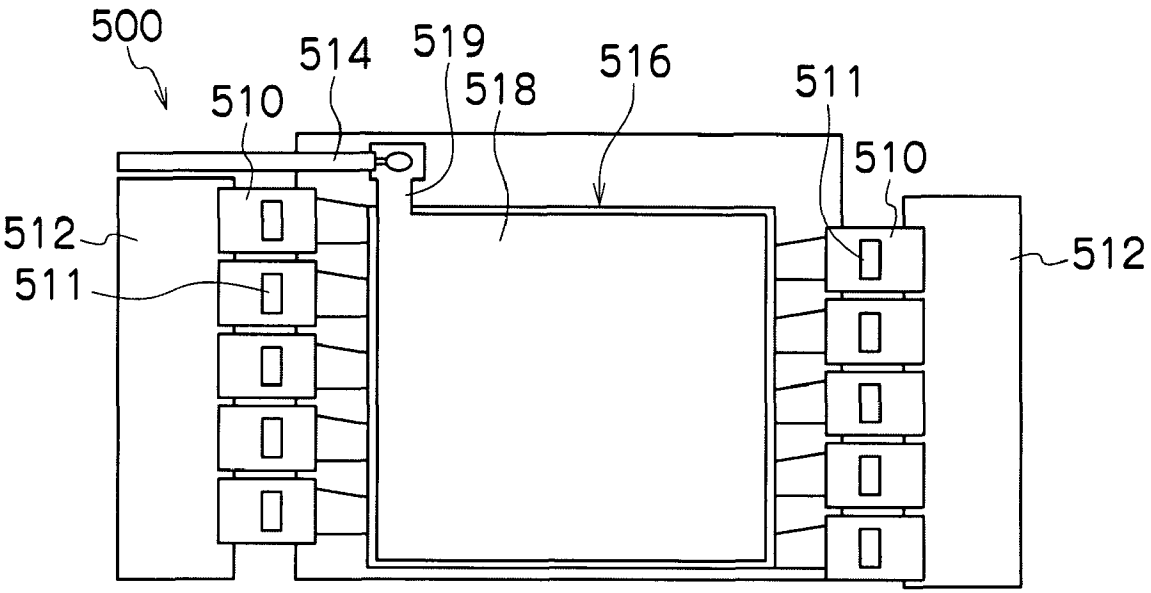
FIGS. 25A and 25B illustrate a schematic configuration of a radiation detection substrate serving as a radiation detector of an optical reading system.
Figure 25B:
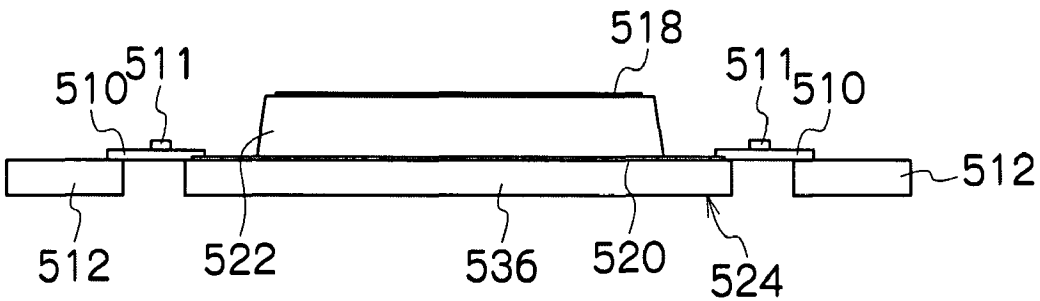

FIGS. 25A and 25B are schematic drawings of the radiation detection substrate 500. As illustrated in FIGS. 25A and 25B, TCP 510 and a read device 512 and a high-voltage wire 514 for applying a high voltage, which are connected via the TCP 510, are connected to the radiation detection substrate 500.

The TCP (Tape Carrier Package) 510 is a flexible wiring board carrying IC (charge amplifying IC) 511 for signal detection. The TCP 510 are connected by thermal press bonding by using an ACF (Anisotropic Conductive Film).

An extending electrode portion 519 that extends from an upper electrode 518 located in the upper portion of a detection area 516 is formed, and the high-voltage wire 514 is connected to the extending electrode portion 519. The detection area 516 that detects radiation is configured by a lower electrode 520 for signal reading and high voltage application, a radiation detection layer 522 that converts radiation into electric charges, and the upper electrode 518 that applies a high voltage.

The lower electrode 520 is provided on a glass substrate 536, and a lower substrate 524 for radiation detection is configured by the glass substrate 536 provided with the lower electrode 520.

The process for manufacturing the radiation detection substrate 500 can be generally divided into production of the lower substrate 524 for radiation detection that includes the lower electrode 520, formation of the radiation detection layer 522 and upper electrode 518, and connection of the high-voltage wire 514.

Figure 26A:
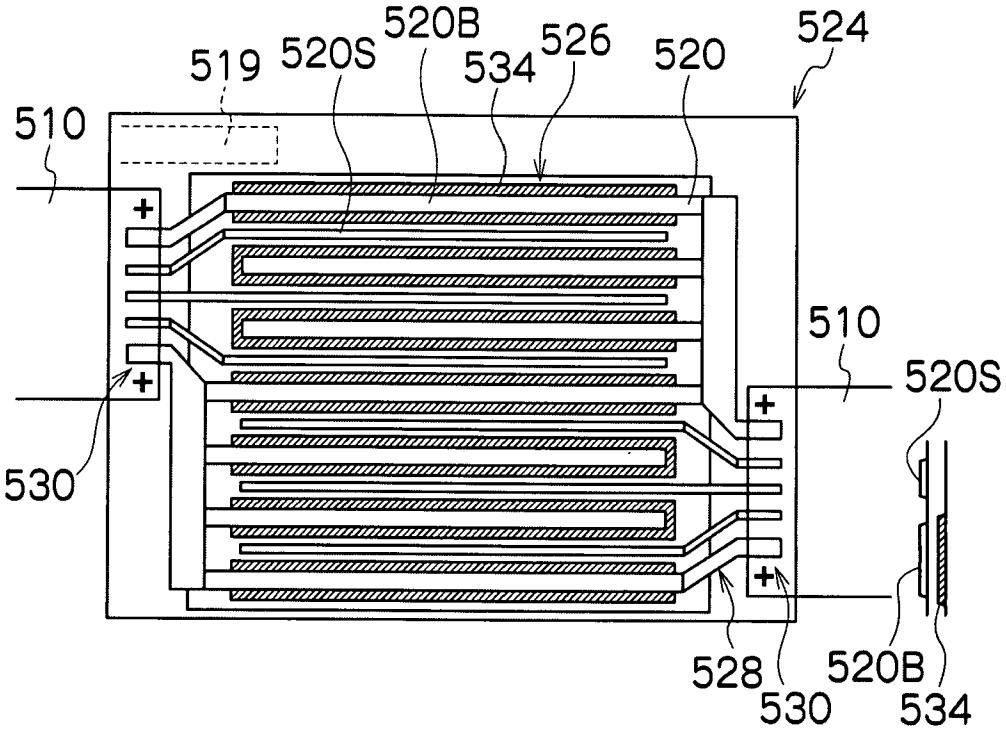
FIGS. 26A and 26B illustrate a schematic structure of a lower substrate for radiation detection of the radiation detection substrate illustrated in FIG. 22.
Figure 26B:
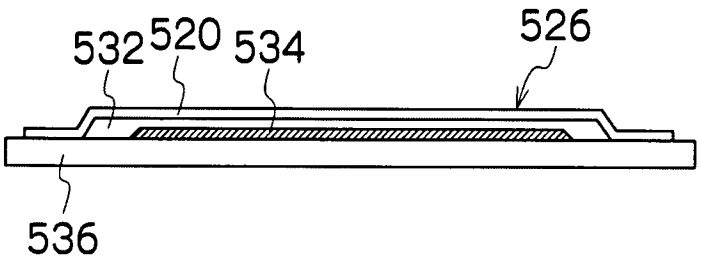

The structure of the lower substrate 524 for radiation detection will be explained below. FIGS. 26A and 26B illustrate a schematic structure of the lower substrate 524 for radiation detection. In the simplified structure illustrated in FIGS. 26A and 26B, The TCP 510 are provided by one on the left and right sides, the number of channels is three on each side, and the total number of channels is six. As illustrated in FIGS. 26A and 26B, the lower substrate 524 for radiation detection is configured by a radiation detection portion 526, a pitch conversion portion 528, and a TCP connection portion 530 serving as a take-out electrode.

In a radiation detection portion 526, the lower electrode 520 for taking out the signals is arranged in a stripe-like (linear) shape. Furthermore, a color filter layer 534 that partially transmits light of a random wavelength is formed on the lower layer via a transparent organic insulating layer 532.

A layer present above the color filter layer 534 is called a common B line 520B, and a portion where the color filter layer 534 is not present is called a signal S line 520S. The B line 520B is shared outside the radiation detection portion and has a comb-shaped electrode structure. The S line 520S is used as a signal line. The width of the B line 520B is, for example, 20 μm, the width of the S line 520S is, for example, 10 μm, and the distance between the B line 520B and the S line 520S is, for example, 10 μm.

The width of the color filter layer 534 is, for example, 30 μm. The lower electrode 520 has to be transparent to enable light irradiation from the back surface and has to be flat to avoid breakdown of the like caused by electric field concentration during application of a high voltage and, for example, IZO or ITO is used therefor. When IZO is used, the thickness is 0.2 μm and the flatness is about Ra=1 nm.

The color filter layer 534 is from a photosensitive resist having a pigment dispersed therein, for example, a red resist used for a color filter of a LCD. A transparent insulating layer 532 of a photosensitive organic material such as PMMA is used to eliminate steps in the color filter layer 534.

The glass substrate 536 serving as a support member is desirably a transparent and rigid substrate. Furthermore, it is desirable that the glass be soda-lime glass. Examples of thickness of each layer are as follows: lower electrode 520: 0.2 μm, color filter layer 534: 1.2 μm, organic transparent insulating layer 532: 1.8 μm, and glass substrate 536: 1.8 μm. The color filter layer 534 and organic insulating layer 532 are present only in the radiation detection portion 526, and the boundaries thereof are present in the radiation detection portion 526 and a pitch conversion portion 528. For this purpose, the IZO wiring is formed on the glass substrate 536 in the TCP connection portion 530 via a boundary step portion of the organic insulating layer 532.

In the radiation detection portion 526, a wiring is taken out to the left and right TCP 510, wherein several packages are considered as a unit. In FIG. 23, three lines are taken as a unit. The number of lines is, for example, 256. The line width in the radiation detection portion 526 is different from the line width in the TCP connection portion 530, and the line width is adjusted in the pitch conversion portion 528 to adjust the line width in the radiation detection portion and pull the wiring around to the predetermined TCP connection position. The B line 520B is shared and similarly pulled out to the TCP connection portion 530.

The signal S line 520S and the common B line 520B shared on the outside of the radiation detection portion are disposed in the TCP connection portion 530. The common B line 520B is disposed outside the signal S line 520S. For example, there are 256 signal lines and they are connected to the TCP by using five upper and five lower common lines. The electrode line-to-space ratio is 40 to 40 μm.

Furthermore, a TCP alignment mark is necessary for connecting the TCP in the TCP connection portion 530. It is desirable that the mark be formed of a transparent electrode, but because the mark is transparent, it is difficult to recognize. For this reason, the alignment mark is formed using a non-transparent material, for example, the color filter layer 534 serving as a constituent member of the substrate.

Figure 27:
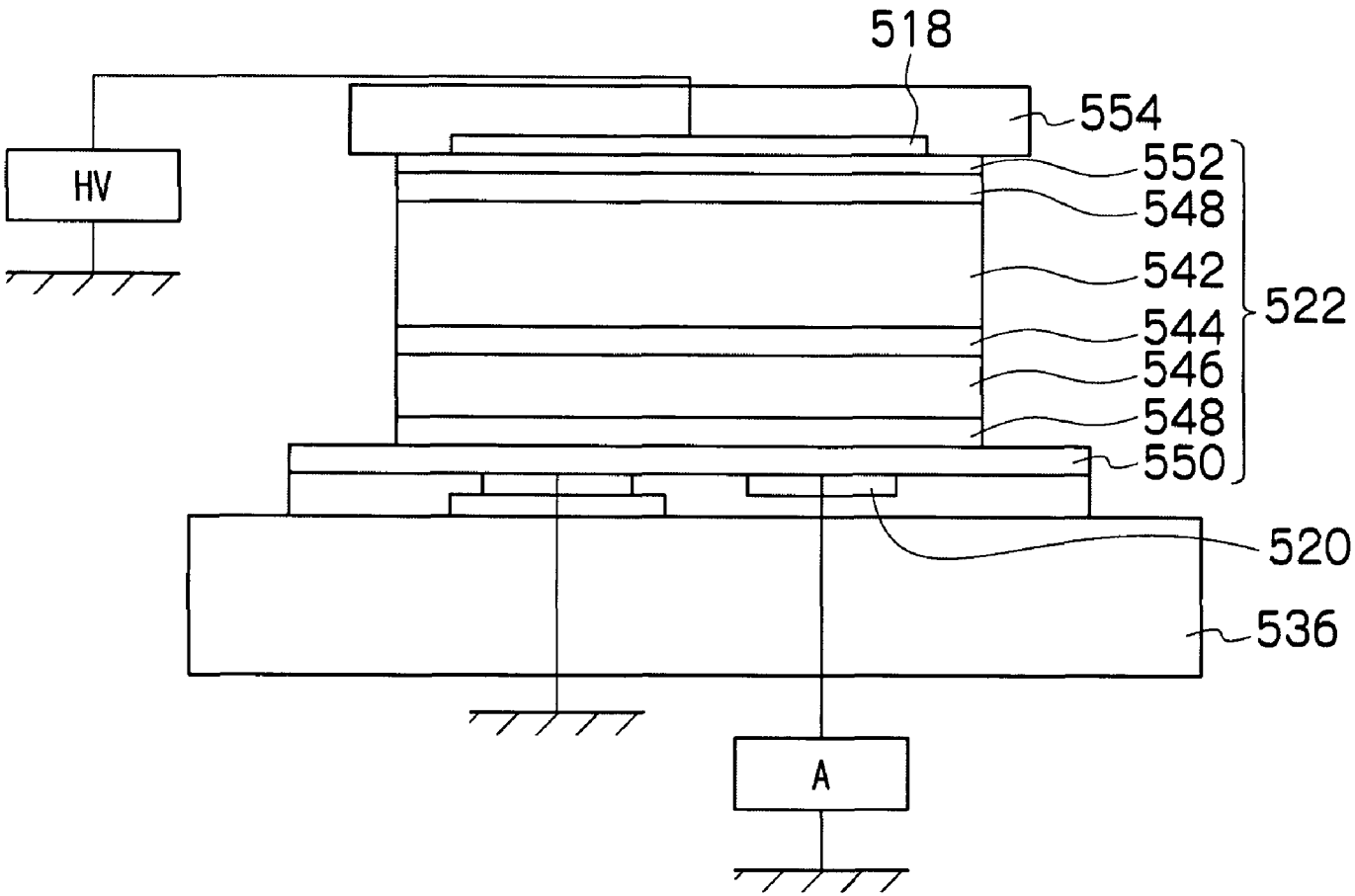
FIG. 27 is a schematic diagram illustrating the configuration of the radiation detection substrate illustrated in FIG. 22.

The radiation detection layer 522 will be explained below. FIG. 27 is a schematic diagram illustrating the configuration of the radiation detection substrate 500. The radiation detection layer is configured by providing a photoconductive layer 542 for recording, a charge accumulating layer 544, a photoconductive layer 546 for reading, an electrode interface layer 548, an underlayer 550, and an overlayer 552, as illustrated in FIG. 27.

Photoconductive Layer for Recording

The photoconductive layer 542 for recording is configured by a compound containing as a main component at least one from among amorphous selenium compounds, $Bi_{12}MO_{20}$ (M: Ti, Si, or Ge), $Bi_4M_3O_{12}$ (M: Ti, Si, or Ge), $Bi_2O_3$, $BiMO_4$ (M: Nb, Ta, or V), $Bi_2WO_6$, $Bi_{24}B_2O_{39}$, ZnO, ZnS, ZnSe, ZnTe, $MNbO_3$ (M: Lie, Na, or K), PbO, $HgI_2$, $PbI_2$, CdS, CdSe, CdTe, $BiI_3$, and GaAs, which are photoconductive substances generating electric charges upon absorption of electromagnetic waves. Among them, amorphous selenium compounds are especially preferred.

In the case of amorphous selenium compounds, those can be used for the layer that are microdoped with 0.001 ppm to 1 ppm an alkali metal such as Li, Na, K, Cs, and Rb, those microdoped with 10 ppm to 10,000 ppm a fluoride such as LiF, NaF, KF, CsF, and RbF, those doped with 50 ppm to 0.5% P, As, Sb, or Ge, those doped with 10 ppm to 0.5% As, and those microdoped with 1 ppm to 100 ppm Cl, Br, or I.

In particular, amorphous selenium containing about 10 ppm to 200 ppm As, amorphous selenium containing about 0.2% to 1% As and also 5 ppm to 100 ppm Cl, and amorphous selenium containing about 0.001 ppm to 1 ppm alkali metal can be advantageously used.

Furthermore, compositions containing fine particles of a photoconductive substance such as $Bi_{12}MO_{20}$ (M: Ti, Si, or Ge), $Bi_4M_3O_{12}$ (M: Ti, Si, or Ge), $Bi_2O_3$, $BiMO_4$ (M: Nb, Ta, or V), $Bi_2WO_6$, $Bi_{24}B_2O_{39}$, ZnO, ZnS, ZnSe, ZnTe, $MNbO_3$ (M: Li, Na, or K), PbO, $HgI_2$, $PbI_2$, CdS, CdSe, CdTe, $BiI_3$, and GaAs with a particle size of from several nanometers to several microns can be used.

In the case of amorphous selenium, the thickness of the photoconductive layer 542 for recording is desirably equal to or greater than 100 μm and equal to or less than 2000 μm. In particular, in applications for mammography, a range of thickness equal to or greater than 150 μm and equal to or less than 250 μm is especially preferred, and in applications for general imaging, a range of thickness equal to or greater than 500 μm and equal to or less than 1200 μm is especially preferred.

Charge Accumulating Layer

The charge accumulating layer 544 may be any film, provided it has insulating properties with respect to charges of a polarity that is wished to be accumulated, and can be configured by a polymer such as an acrylic organic resin, a polyimide, BCB, PVA, acryl, polyethylene, a polycarbonate, and a polyetherimide, a sulfide such as $As_2S_3$, $Sb_2S_3$, and ZnS, and also by an oxide and a fluoride. Furthermore, a substance that has insulating properties with respect to charges of a polarity that is wished to be accumulated and has conductive properties with respect to charges of opposite polarity is more preferred, and also a substance is preferred in which a difference in a product of mobility×life between the charges of different polarity is equal to or greater than three orders of magnitude.

Examples of preferred substances include $As_2Se_3$, $As_2Se_3$ doped with 500 ppm to 20,000 ppm Cl, Br, and I, $As_2(Se_xTe_{1-x})_3$ ($0.5<x<1$) obtained by substituting Se in $As_2S_3$ with Te up to about 50%, $As_2Se_3$ in which Se is substituted with S up to about 50%, $As_xSe_y$ ($x+y=100$, $34 \leqq x \leqq 46$) obtained by changing As concentration from $As_2Se_3$ by about ±15%, and an amorphous Se—Te system containing 5 to 30 wt. % Te.

When a substance containing such chalcogenide elements is used, the thickness of the charge accumulating layer 544 is desirably equal to or greater than 0.4 μm and equal to or less than 3.0 μm, more desirably equal to or greater than 0.5 μm and equal to or less than 2 μm. Such a charge accumulating layer 544 may be formed by a single-step formation process, or may be obtained by lamination in a plurality of steps.

A compound obtained by doping a polymer such as an acrylic organic resin, a polyimide, BCB, PVA, acryl, polyethylene, a polycarbonate, and a polyetherimide with a charge transfer agent can be advantageously used as the preferred charge accumulating layer 544 using an organic film. Examples of preferred charge transfer agents include molecules selected from a group including tris(8-quinolinolato) aluminum (Alq3), N,N-diphenyl-N,N-di(m-tolyl)benzidine (TPD), polyparaphenylenevinylene (PPV), a polyalkylthiophene, polyvinylcarbazole (PVK), triphenylene (TNF), metal phthalocyanines, 4-(dicyanomethylene)-2-methyl-6-(p-dimethylaminostyryl)-4H-pyran (DCM), liquid crystal molecules, hexapentyloxytriphenylene, discotic liquid crystal molecules in which a central core has a π-conjugated condensation ring or a transition metal, carbon nanotubes, and fullerenes. The doped amount is set between 0.1 wt. % and 50 wt. %.

Photoconductive Layer for Reading

The photoconductive layer 546 for reading can used a semiconductor substance in which an energy gap is contained within a range of 0.7 eV to 2.5 eV, such as amorphous selenium compounds, amorphous Si:H, crystalline Si, and GaAS, which are photoconductive substance generating electric charges upon absorption of electromagnetic waves, in particular visible light. Among them, amorphous selenium is especially preferred.

In the case of amorphous selenium compounds, those can be used for the layer that are microdoped with 0.001 ppm to 1 ppm an alkali metal such as Li, Na, K, Cs, and Rb, those microdoped with 10 ppm to 10,000 ppm a fluoride such as LiF, NaF, KF, CsF, and RbF, those doped with 50 ppm to 0.5% P, As, Sb, or Ge, those doped with 10 ppm to 0.5% As, and those microdoped with 1 ppm to 100 ppm Cl, Br, or I. In particular, amorphous selenium containing about 10 ppm to 200 ppm of As, amorphous selenium containing about 0.2% to 1% As and also 5 ppm to 100 ppm Cl, and amorphous selenium containing about 0.001 ppm to 1 ppm alkali metal can be advantageously used.

The photoconductive layer 546 for reading can have any thickness, provided that the reading light can be sufficiently absorbed and an electric field created by electric charges accumulated in the charge accumulating layer 544 can move the electric charges that have been excited by light. The preferred thickness is from about 1 μm to 30 μm.

Electrode Interface Layer

The electrode interface layer 548 is provided between the photoconductive layer 542 for recording and the upper electrode 518 or between the photoconductive layer 546 for reading and the lower electrode 520. From the standpoint of preventing crystallization, amorphous selenium having added thereto As within a range of 1% to 20%, amorphous selenium having added thereto S, Te, P, Sb, or Ge within a range of 1% to 10%, and amorphous selenium having added thereto the above-described elements and other elements are preferred.

Furthermore, $As_2S_3$ or $As_2Se_3$, which have a higher crystallization temperature, can be also advantageously used. Furthermore, with the object of preventing charge injection from the electrode layers, in addition to the additive elements, alkali metals such as Li, Na, K, Rb, and Cs and molecules such as LiF, NaF, KF, RbF, CsF, LiCl, NaCl, KCl, RbF, CsF, CsCl, and CsBr are desirably doped within a range of 10 ppm to 5000 ppm in particular in order to prevent the injection of holes. Conversely, halogen elements such as Cl, I, and Br and molecules such as $In_2O_3$ are desirably doped within a range of 10 ppm to 5000 ppm in order to prevent the injection of electrons. The thickness of the interface layer can be set between 0.05 μm to 1 μm so as to attain sufficiently the above-described objects.

The above-described electrode interface layer 548, photoconductive layer 546 for reading, charge accumulating layer 544, and photoconductive layer 542 for recording are laminated on the substrate in a vacuum tank with a degree of vacuum of from $10^{-3}$ to $10^{-7}$ Torr by holding the substrate at a temperature equal to or higher than 25° C. and equal to or lower than 70° C., heating a boat or crucible having the aforementioned metals introduced therein by resistance heating or electron beam, and evaporating or sublimating the alloys and compounds.

When the evaporation temperatures of the alloys and compounds differ significantly from each other, it is preferred that a plurality of boats corresponding to a plurality to vapor deposition sources be heated simultaneously and controlled individually and that the concentration of additives and concentration of dopants be controlled. For example, an As-doped (10%) layer of amorphous selenium doped with 5000 ppm LiF can be formed by introducing $As_2Se_3$, amorphous selenium, and LiF in respective boats, heating the boat containing $As_2Se_3$ to 340° C., the boat containing amorphous selenium (a-Se) to 240° C., and the boat containing LiF to 800° C., and opening and closing shutters of each boat.

Underlayer

The underlayer 550 can be provided between the photoconductive layer 546 for reading and the lower electrode (charge collecting electrode) 520. When the electrode interface layer (crystallization preventing layer (A layer)) 548 is present, the underlayer is desirably provided between the electrode interface layer 548 and the lower electrode 520. From the standpoint of reducing a dark current and a leak current, it is preferred that the underlayer 550 have a rectification property. When a positive bias is applied to the upper electrode 518, the underlayer desirably has an electron blocking ability, and when a negative bias is applied, the underlayer desirably has a hole blocking ability.

A resistivity of the underlayer is desirably equal to or higher than $10^8$ Ωcm and a thickness thereof is desirably 0.01 μm to 10 μm. A layer having a composition such as $Sb_2S_3$, SbTe, ZnTe, CdTe, SbS, AsSe, and $As_2S_3$ or an organic polymer layer is preferred as the layer having an electron blocking ability, that is, an electron injection blocking layer. A film in which NPD and TPD are mixed with a polymer having a hole transfer ability such as PVK or an insulating polymer such as a polycarbonate, polystyrene, a polyimide, and a polycycloolefin can be advantageously used as the organic polymer layer.

A film such as CdS and $CeO_2$ or an organic polymer layer is preferred as the layer having a hole blocking ability, that is, a hole injection blocking layer. A film obtained by mixing a carbon cluster such as C60 (fullerene) or C70 with an insulating polymer such as a polycarbonate, polystyrene, a polyimide, and a polycycloolefin can be advantageously used as the organic polymer layer.

A thin insulating polymer layer can be also advantageously used. For example, parylene, a polycarbonate, PVA, PVP, PVB, a polyester resin, and an acrylic resin such as polymethyl methacrylate is preferred as the insulating polymer layer. The layer thickness in this case is desirably equal to or less than 2 μm, more desirably equal to or less than 0.5 μm.

Overlayer

The overlayer 552 can be provided between the photoconductive layer 542 for recording and the upper electrode (voltage application electrode) 518. When the electrode interface layer (crystallization preventing layer (C layer)) 548 is present, the overlayer is desirably provided between the electrode interface layer 548 and the upper electrode 518. From the standpoint of reducing a dark current and a leak current, it is preferred that the overlayer 552 have a rectification property.

When a positive bias is applied to the upper electrode 518, the overlayer desirably has a hole blocking ability, and when a negative bias is applied, the overlayer desirably has an electron blocking ability. A resistivity of the overlayer is desirably equal to or higher than $10^8$ Ωcm and a thickness thereof is desirably 0.01 μm to 10 μm.

An organic polymer layer is preferred as the layer having an electron blocking ability, that is, an electron injection blocking layer. A film in which NPD and TPD are mixed with a polymer having a hole transfer ability such as PVK or an insulating polymer such as a polycarbonate, polystyrene, a polyimide, and a polycycloolefin can be advantageously used as the organic polymer layer.

An organic polymer layer is preferred as the layer having a hole blocking ability, that is, a hole injection blocking layer. A film in which a hole blocking material is mixed with an insulating polymer such as a polycarbonate, polystyrene, a polyimide, and a polycycloolefin can be advantageously used as the organic polymer layer.

At least one from among the hole blocking materials contained in the hole injection blocking layer 402 is desirably of at least one kind selected from carbon clusters or derivatives thereof. The carbon cluster is desirably of at least one kind selected from fullerene C60, fullerene C70, fullerene oxide, and derivatives thereof.

A thin insulating polymer layer can be also advantageously used. For example, parylene, a polycarbonate, PVA, PVP, PVB, a polyester resin, and an acrylic resin such as polymethyl methacrylate is preferred as the insulating polymer layer. The layer thickness in this case is desirably equal to or less than 2 μm, more desirably equal to or less than 0.5 μm.

The upper electrode 518 and a surface protective layer 554 formed on the surface of the upper electrode 518 will be explained below.

Upper Electrode

A thin metal film is desirably used as the upper electrode 518 formed on the upper surface of the photoconductive layer 542 for recording. Examples of materials suitable for forming the upper electrode include metals such as Au, Ni, Cr, Pt, Ti, Al, Cu, Pd, Ag, Mg, a MgAg 3 to 20% alloy, a Mg—Ag intermetallic compound, a MgCu 3 to 20% alloy, and a Mg—Cu intermetallic compound.

It is especially preferred that Au, Pt, or a Mg—Ag intermetallic compound be used. for example, when Au is used, the thickness is desirably equal to or greater than 15 nm and equal to or less than 200 nm, more desirably equal to or greater than 30 nm and equal to or less than 100 nm. For example, when a MgAg 3 to 20% alloy is used, it is more preferred that the thickness be equal to or greater than 100 nm and equal to or less than 400 nm.

Any method of producing the upper electrode can be used, but the preferred method is vapor deposition employing a resistance heating system. For example, a metal lump is melted in a boat by using a resistance heating system, a shutter is then opened and vapor deposition is performed for 15 sec, followed by cooling. The upper electrode is formed by repeating the above-described operation a plurality of times till a resistance value is sufficiently reduced.

Surface Protective Layer

In order to form a latent image in a radiation device by irradiation with radiation, a high voltage of several kilovolts is applied to the upper electrode 518. Where the upper electrode 518 is exposed to the atmosphere, a surface charge occurs and there is a possibility of subjecting the object of imaging to an electric shock. In order to prevent the surface discharge on the upper electrode 518, an insulating treatment is performed by forming the surface protective layer 554 on the upper surface of the electrode.

The insulating treatment has to produce a structure that completely prevents the electrode surface from contact with the atmosphere, this structure tightly covering the surface with an insulator. This insulator has to have an electric breakdown resistance that exceeds the applied potential. Furthermore, for the radiation detection device to maintain its functionality, the insulator has to be a member that does inhibit the penetration of radiation. Vapor deposition or solvent coating of an insulating polymer are the preferred methods and material ensuring the required high covering ability, insulation breakdown resistance, and radiation transmissivity.

More specifically, a method can be used by which an epoxy resin curable at normal temperature, a polycarbonate resin, a polyvinyl butyral resin, a polyvinyl alcohol resin, an acrylic resin, or a polyparaxylylene derivative are coated by a CVD method. Among them, forming a film of an epoxy resin curable at normal temperature or polyparaxylylene by a CVD method is preferred, and a process for forming a film of a polyparaxylylene derivative by a CVD method is especially preferred. The film thickness is desirably equal to or greater than 10 μm and equal to or less than 1000 μm, more desirably equal to or greater than 20 μm and equal to or less than 100 μm.

Because a polyparaxylylene film can be formed at room temperature, it is possible to obtain an insulating film that does not provide thermal stresses to the object of coating and has an extremely high step coverability. However, because such a film is chemically extremely stable, adhesion thereof to the coating object is most often unsatisfactory. A physical treatment such as a treatment with a coupling agent, corona discharge, plasma treatment, ozone cleaning, acid treatment, and surface roughening or a chemical treatment are generally known and can be used for treating the coating object prior to forming a polyparaxylylene film in order to improve adhesion to the coating object. A method of improving adhesion to the coating object is preferred by which a silane coupling agent or a silane coupling agent diluted, if necessary, with an alcohol is coated at least on a portion in which the adhesion to the coating object is wished to be increased and a polyparaxylylene film is then formed.

Furthermore, damp proofing is desirably implemented to prevent the radiation detection device from deteriorating with time. More specifically, a structure covered with a damp-proofing material is obtained. A sufficient function cannot be obtained with a resin alone, such as the above-described insulating polymers, and a configuration having at least an inorganic material layer such as glass or aluminum laminate film can be effectively used as the damp-proofing material. Because glass attenuates radiation transmission, a thin aluminum laminate film is preferred as the damp-proofing member. For example, a laminate of PET (12 μm)/rolled aluminum (9 μm)/nylon (15 μm) is an aluminum laminate film that is generally used as a damp-proofing packaging material.

The aluminum thickness is desirably equal to or more than 5 μm and equal to or less than 30 μm. The thickness of each of the PET and nylon located above and below the aluminum is equal to or greater than 10 μm and equal to or less than 100 μm. Such a film has an X ray attenuation of about 1% and is optimum as a member demonstrating both the damp-proofing effect and X ray transmission.

Figure 28:
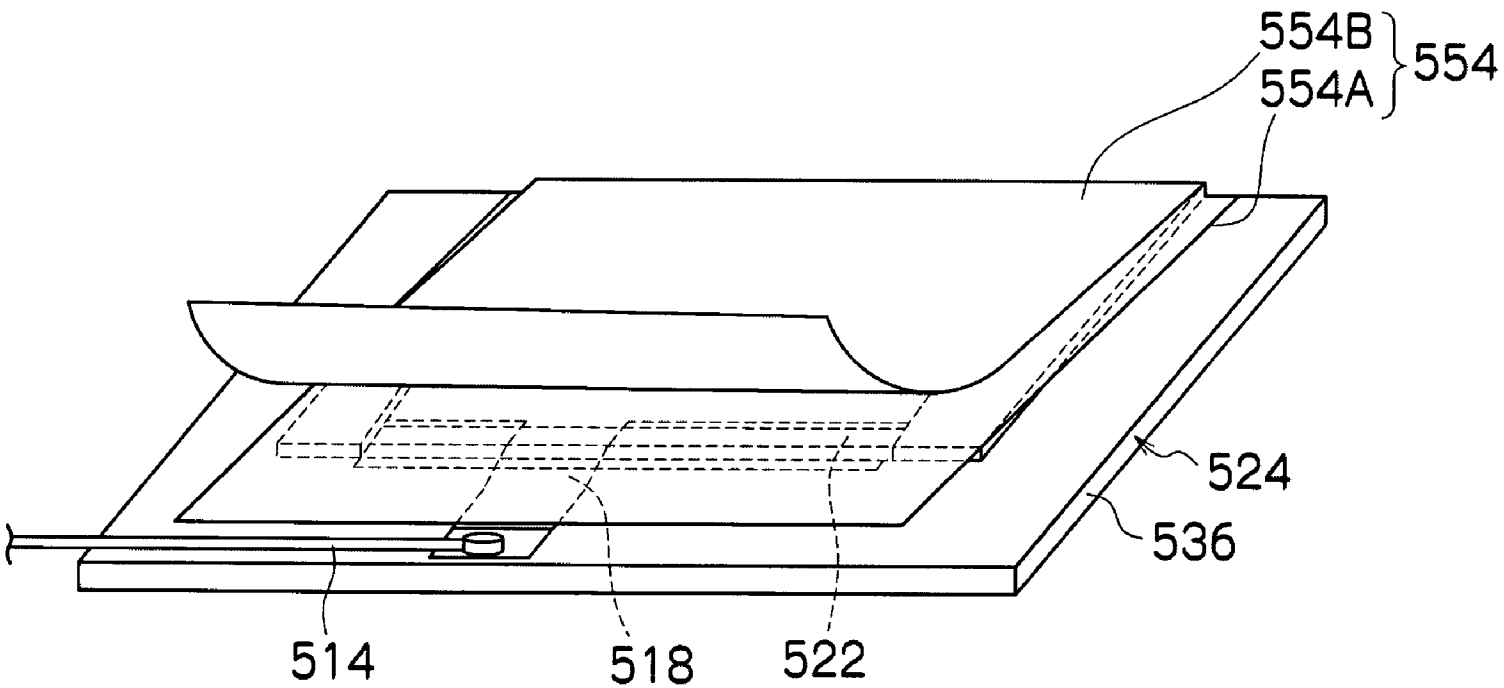
FIG. 28 illustrates a sealing structure that seals the upper electrode of the radiation detection substrate illustrated in FIG. 22.

For example, as illustrated in FIG. 28, the entire surface of a radiation detection device subjected to insulating treatment with a polyparaxylylene 554A is covered with a damp-proofing film 554B, and the outer periphery of the damp-proofing film 554B is bonded and fixed to the substrate with an adhesive outside the radiation detection device region. As a result, a configuration is obtained in which the radiation detection device is sealed with the damp-proofing film 554B.

Because the polyparaxylylene 554A is chemically extremely stable during such bonding and fixing, bonding ability thereof to other members attained with an adhesive is generally poor. However, the bonding ability can be improved by performing light irradiation treatment with ultraviolet radiation prior to bonding. The necessary irradiation time is appropriately adjusted to an optimum value based on the wavelength and power of the ultraviolet radiation source used, but a low-pressure mercury lamp with a power of 1 W to 50 W is preferred, and light irradiation is desirably carried out for 1 min to 30 min.

The radiation detection device of the present embodiment uses amorphous selenium and it is possible that at a high temperature equal to or higher than 40° C., amorphous selenium will crystallize and a latent image formation function will not be obtained. Therefore, heating is unsuitable in adhesive processing. Accordingly, an adhesive curable at room temperature is preferred, and a two-liquid mixed epoxy adhesive curable at room temperature that has a high bonding strength is an optimum adhesive. This epoxy adhesive is applied on the outer periphery of the radiation detection device and a damp-proofing film 554B is covered. The bonding portion is uniformly pressed and fixed from the upper surface of the damp-proofing film 554B and curing is performed by allowing the joint to stay for 12 hr or longer in this state in an environment at room temperature. The pressure is released after the adhesive is cured and a sealed structure is obtained.

Supplementary explanation of the sealing structure member will be given below. When the radiation detection device is used for mammography, image detection at a low dose is preferred to reduce exposure during X ray imaging. In order to detect shadow variations in low-dose irradiation, it is desirable to increase X ray transmissivity of members other than the object of examination (mamma) in the path from the radiation source to the device, thereby making it possible to obtain a clear image.

An example of the preferred protective layer and sealing structure is illustrated in FIG. 28, but such a configuration is not limiting. By forming a protective film, the humidity environment of the device is desirably maintained at a level of equal to or lower than 30%, more desirably equal to or lower than 10%.

Charge Take-Out Amplifier

Figure 29:
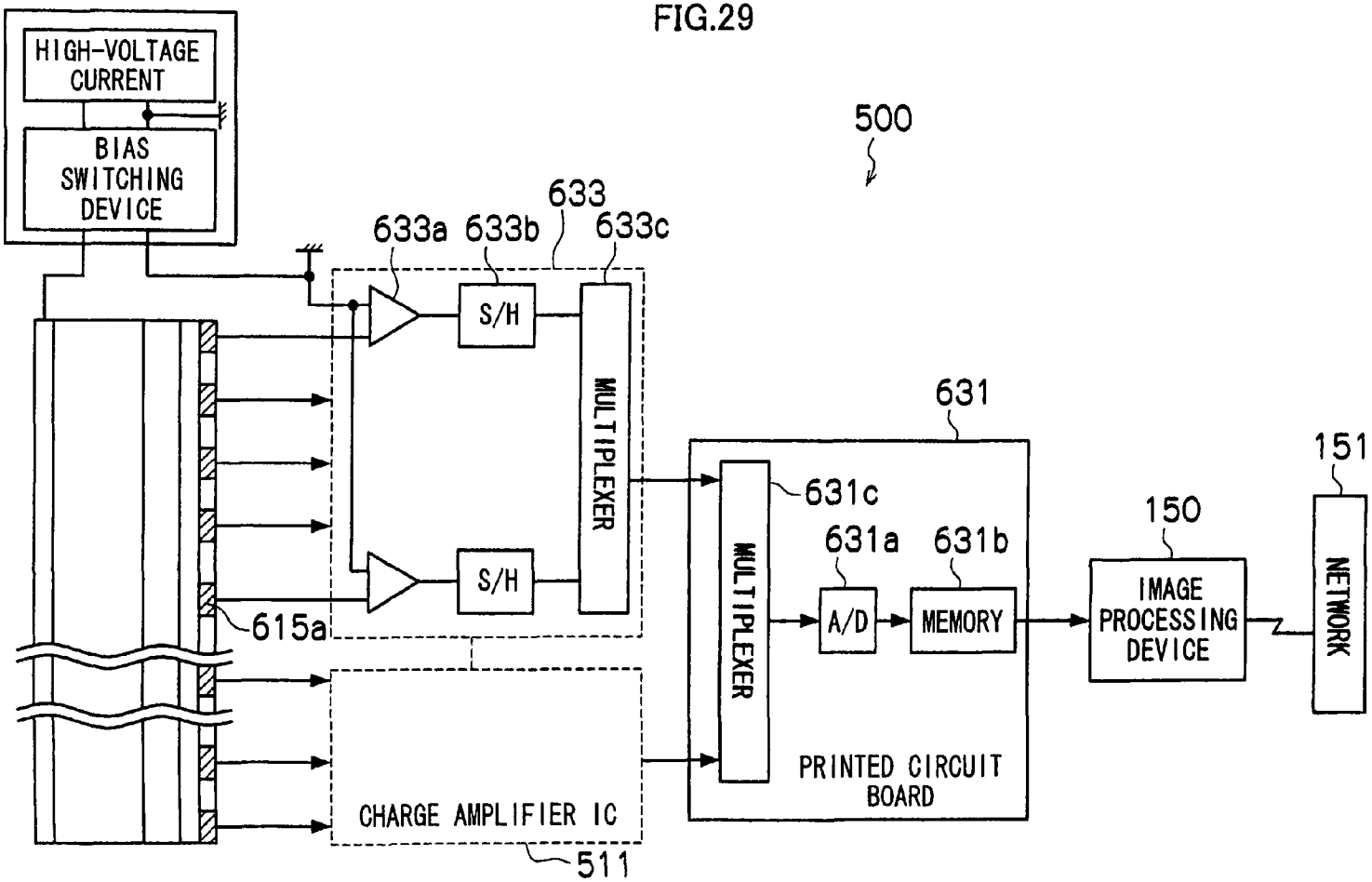
FIG. 29 is a block diagram illustrating the configuration of a charge take-out amplifier, and a connection mode between this configuration and an image processing device and other devices disposed outside the radiation detection substrate.

In the present embodiment, the electric charges are amplified by an amplifier and then AD converted. FIG. 29 is a block diagram illustrating the configuration of the charge take-out amplifier and a connection mode thereof with an image processing device 150 disposed outside the radiation detection substrate 500.

A charge amplifier IC 511 serving as the charge take-out amplifier is provided with a large number of charge amplifiers 633*a* and sample-and-hold units (S/H) 633*b* connected to respective elements 615*a* of the radiation detection substrate 500 and also a multiplexer 633*c* that multiplexes signals from the sample holders 633*b*.

An electric circuit flowing from the lower electrode is converted into voltage by each charge amplifier 633*a*, the voltage is sampled and held at a predetermined timing by the sample-and-hold units 633*b*, and the sampled and held voltage corresponding to each element 615*a* is successively outputted from the multiplexer 633*c* so as to be changed into an arrangement sequence of elements 615*a* (corresponds to part of the main scanning).

Signals successively outputted from the multiplexer 633*c* are inputted in the multiplexer 631*c* provided on the printed circuit board 631 and a voltage corresponding to each element 615*a* is successively outputted from the multiplexer 631*c* so as to be converted into an arrangement sequence of elements 615*a*.

Signals successively outputted from the multiplexer 631*c* are converted into digital signals by an A/D conversion unit 631*a*, and the digital signals are stored in the memory 631*b*. Image signals stored in the memory 631*b* are sent via a signal cable to an external image processing unit 150, an appropriate image processing is performed in the image processing unit 150, and the processed image is uploaded together with pick-up information to a network 151 and sent to a server or a printer.

Image Acquisition Sequence

Figure 30:
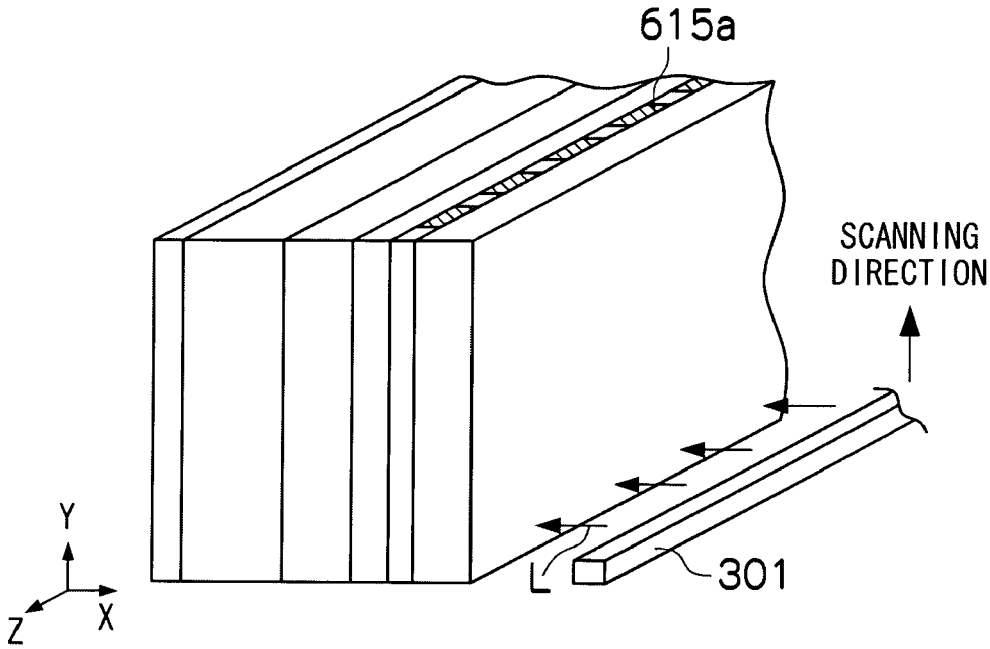
FIG. 30 is a schematic diagram illustrating a situation when the scanning is performed using line light as read-out light.

An image formation sequence of the present image recording and reading system is basically composed of a process of irradiating with a recording light (or X rays) under applied high voltage and accumulating latent image charges and a process of irradiating with a reading light and reading the latent image charges after completion of high-voltage application. A method of scanning a line light source 301 in the electrode direction (see FIG. 30) as a reading light L is optimum, but other methods can be also used.

If necessary, a process of completely erasing the residual latent image charges can be included. This erasure process is carried out by irradiating the entire surface of the panel with an erasure light. It is possible to irradiate the entire surface once or scan a line light or spot line over the entire surface. The erasure process is carried out after the reading process and/or before the latent image accumulation process. When the erasure light is irradiated, the erasing efficiency can be increased by combining high-voltage application with the irradiation. Furthermore, electric charges (dark current charges) created by a dark current generated during high-voltage application can be erased by performing "pre-exposure" after the high-voltage application, but before the irradiation with recording light.

It is also known that various charges can be accumulated for a variety of other reasons on electrostatic recording bodies prior to irradiation with recording light. It is desirable that these residual signals be reduced by correction in order to prevent them from adversely affecting image information signals that are successively outputted as residual image development.

A method in which a residual image reading process is added to the above-described image recording and reading processes is effective as a method of correcting the residual image signals. The residual image reading process is carried out by performing the high-voltage application without irradiation with a recording light and then reading the "residual image". The residual image signal can be corrected by subjecting the "residual image" signals to appropriate processing and subtracting them from "recorded images". The residual image reading process is carried out before the image recording and reading process or after it. Furthermore, an appropriate erasure process can be combined before and/or after the residual image reading process.

In the radiation detection substrate 500 serving as a radiation detector of an optical reading system, the upper electrode 518 corresponds to the first electrode in accordance with the present invention, the radiation detection layer 522 having the photoconductive layer 542 for recording corresponds to the photoconductive layer in accordance with the present invention, the lower electrode 520 corresponds to the second electrode in accordance with the present invention, the TCP connection portion 530 corresponds to the take-out electrode in accordance with the present invention, and the overlayer 552 corresponds to the organic polymer layer in accordance with the present invention.

In the radiation detection substrate 500 of an optical reading system, the overlayer 552 can be configured in the below-described manner as in the above-described radiation detector 400.

The outer edge portion of the overlayer 552 serving as an organic polymer layer, that is a circumferential edge serving as a boundary with other layers, is located in a predetermined position, thereby producing a configuration in which the overlayer 552 is formed in a predetermined range and covers the predetermined range.

Figure 31A:
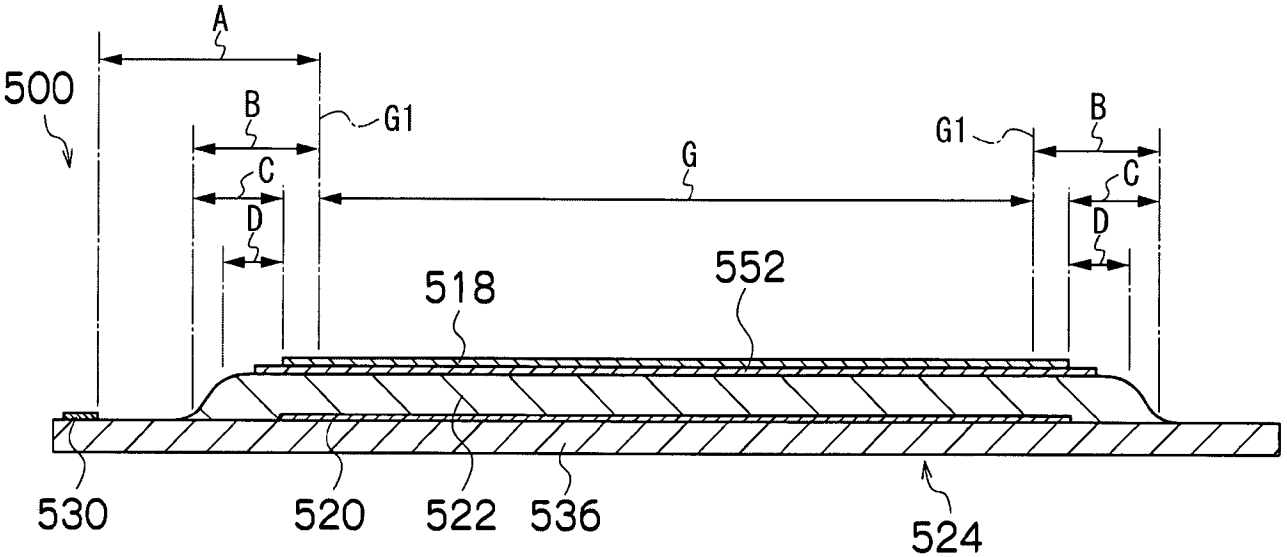
FIGS. 31A and 31B illustrate an example of applying the configuration of the hole injection blocking layer in the radiation detector of a TFT system illustrated in FIGS. 20A and 20B, to the radiation detection substrate illustrated in FIGS. 25A and 25B.

In the present embodiment, the outer edge portion of the overlayer 552 is positioned between the TCP connection portion 530 and the region end GI of the image information acquisition region G in which image information is acquired within a region irradiated with radiation carrying image information. The range represented by arrow A in FIG. 31A is a range between the TCP connection portion 530 and the region end G1 of the image information acquisition region G In the preferred configuration, the outer edge portion of the overlayer 552 of the present embodiment is located outside the image information acquisition region G and within a region having a film thickness equal to or greater than 10% the average film thickness of the flat portion of the radiation detection layer 522. The average film thickness of the flat portion of the radiation detection layer 522 is determined by measuring a film thickness in any nine points within a region of the image information acquisition region G of the radiation detection layer 522 and finding an average film thickness for these nine points. The film thickness is measured by observing the cross section of the film under a microscope with a magnification factor of 100.

A range represented by arrow B in FIG. 31A is outside the image information acquisition region G and within a region having a film thickness equal to or greater than 10% the average film thickness of the flat portion of the radiation detection layer 522.

In even more preferred configuration, the outer edge portion of the overlayer 552 of the present embodiment is located outside the upper electrode 518 and within a region having a film thickness equal to or greater than 10% the average film thickness of the flat portion of the radiation detection layer 522.

A range represented by arrow C in FIG. 31A is outside the upper electrode 518 and within a region having a film thickness equal to or greater than 10% the average film thickness of the flat portion of the radiation detection layer 522.

In even more preferred configuration, the outer edge portion of the overlayer 552 of the present embodiment is located outside the upper electrode 518 and within a region in which a gradient of an end portion bevel of the radiation detection layer 522 is equal to or less than 50%.

Figure 31B:
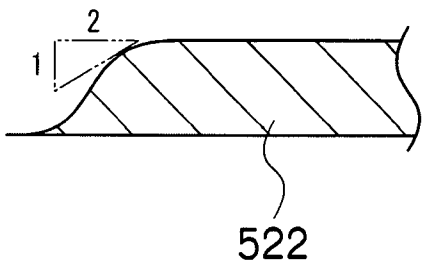

The outer edge portion of the overlayer 552 is positioned within a region with a gradient of equal to or less than 50% in the end portion bevel of the radiation detection layer 522 in which the gradient gradually increases from the flat portion to the outer edge, that is, within a range in which the gradient is more gradual than a gradient of 50%. The gradient of 50% is a gradient formed by an inclined side in a rectangular triangle configured by a side along the film thickness direction of the radiation detection layer 522, a side perpendicular to this side, and the inclined side, as illustrated in FIG. 31B, in which where the length of the side along the film thickness direction of the radiation detection layer 522 is taken as 1, the length of the side perpendicular to this side is 2. The gradient is measured by observing the cross section under a microscope with a magnification of 100.

A range represented by arrow D in FIG. 31A is outside the upper electrode 518 and within a region in which the gradient of the end portion bevel of the radiation detection layer 522 is equal to or less than 50%.

The radiation detection layer 522 is formed in a region wider than the upper electrode 518. Furthermore, the lower electrode 520 is formed in a region wider than the image information acquisition region G.

The present invention is not limited to the above-described embodiments, and various changes, variations, and modifications, can be made.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid coating method comprising the steps of:

ejecting droplets from nozzles of a recording head onto an imaging region of a surface of a substrate placed on a support plate; and controlling the recording head so that a dot pitch $\phi$ that is an interval between landing positions of the droplets on the surface of the substrate satisfies a following condition:

$$\phi \le 2\sqrt[3]{\frac{3V(1+\cos\theta_a)\sin\theta_a}{\pi(1-\cos\theta_a)(2+\cos\theta_a)}}$$

where V stands for a volume of a droplet ejected from each of the nozzles and $\phi_a$ stands for an advancing contact angle of the droplet against the substrate, and controlling scanning of the recording head so that a nozzle pitch of the recording head, which is an interval along a direction perpendicular to a scanning direction along which the recording head is scanned, is an integral multiple of the dot pitch $\phi$.

2. The liquid coating method as defined in claim 1, wherein the advancing contact angle $\theta_a$ and a receding contact angle $\theta_r$ standing for a receding contact angle of the droplet ejected from each of the nozzles against the substrate satisfy a following condition:

$$\theta_r \le 2\arctan\left\{\frac{\pi}{3}\frac{(1-\cos\theta_a)(2+\cos\theta_a)}{(1+\cos\theta_a)\sin\theta_a}\frac{r^2}{\phi^2}\right\} \le \theta_a$$

where r stands for a radius of one droplet with the volume V on the surface of the substrate when the one droplet has wetly spread under condition of the advancing contact angle $\theta_a$.

3. The liquid coating method as defined in claim 2, wherein the advancing contact angle $\theta_a$ and the receding contact angle $\theta_r$ satisfy a following condition:

$$\theta_r \le 2\arctan\left\{\frac{\pi}{12}\frac{(1-\cos\theta_a)(2+\cos\theta_a)}{(1+\cos\theta_a)\sin\theta_a}\right\} \le \theta_a$$

4. The liquid coating method as defined in claim 2, wherein the imaging region is a rectangular region having a size $L_a$ in a first direction and a size $L_b$ in a second direction perpendicular to the first direction, and the droplets are caused to land substantially equidistantly with an interval equal to or larger than $L_a/(2r)$ in the first direction and an interval equal to or larger than $L_b/(2r)$ in the second direction.

5. The liquid coating method as defined in claim 1, wherein when the droplets are ejected onto the imaging region, only one scanning is performed over the imaging region.

6. A liquid coating device comprising:

a support plate onto which a substrate is placed;

a recording head having a plurality of nozzles that eject droplets on an imaging region of a surface of the substrate placed on the support plate; and a control device which controls an ejection amount from the recording head in such a manner that a volume V of a droplet ejected from each of the plurality of nozzles of the recording head onto the substrate satisfies a following condition:

$$V \ge \frac{\pi}{24}\frac{(1-\cos\theta_a)(2+\cos\theta_a)}{(1+\cos\theta_a)\sin\theta_a}\phi^3$$

where $\theta_a$ stands for an advancing contact angle of the droplet against the substrate and $\phi$ stands for a dot pitch that is an interval between landing positions of the droplets on the surface of the substrate.

7. The liquid coating device as defined in claim 6, wherein the control device controls the ejection from the recording head in such a manner that a receding contact angle $\theta_r$ of the droplet ejected from each of the plurality of nozzles against the substrate satisfies a following condition:

$$\theta_r \leq 2\ \arctan\left\{\sqrt[3]{\frac{\pi}{3}\frac{(1-\cos\theta_a)(2+\cos\theta_a)}{(1+\cos\theta_a)\sin\theta_a}V^2}\ \frac{1}{\phi^2}\right\} \leq \theta_a$$

8. The liquid coating device as defined in claim 7, wherein the control device controls the ejection from the recording head in such a manner that the advancing contact angle $\theta_a$ and the receding contact angle $\theta$, satisfy a following condition:

$$\theta_r \leq 2\ \arctan\left\{\sqrt[3]{\frac{\pi}{3}\frac{(1-\cos\theta_a)(2+\cos\theta_a)}{(1+\cos\theta_a)\sin\theta_a}V^2}\ \frac{1}{4r^2}\right\} \leq \theta_a$$

where r stands for a radius of one droplet with the volume V on the surface of the substrate when the one droplet has wetly spread under condition of the advancing contact angle $\theta_a$.

9. The liquid coating device as defined in claim 7, wherein when the imaging region is a rectangular region having a size $L_a$ in a first direction and a size $L_b$ in a second direction perpendicular to the first direction, the control device controls the ejection from the recording head in such a manner that the droplets are caused to land substantially equidistantly with an interval equal to or larger than $L_a/(2r)$ in the first direction and an interval equal to or larger than $L_b/(2r)$ in the second direction.

10. The liquid coating device as defined in claim 6, further comprising a scanning device which performs relative scanning of the recording head and the substrate relative, wherein when the droplets are ejected onto the imaging region, the scanning device performs the relative scanning in such a manner that only one scanning is performed over the imaging region.

11. The liquid coating device as defined in claim 6, wherein a nozzle pitch of the recording head, which is the interval along a direction perpendicular to a scanning direction along which the recording head is scanned, corresponds to the dot pitch.

12. The liquid coating device as defined in claim 6, wherein a nozzle pitch of the recording head, which is the interval along a direction perpendicular to a scanning direction along which the recording head is scanned, is an integral multiple of the dot pitch.

13. A method of manufacturing a radiation detector which has: a first electrode that transmits a radiation that carries image information; a photoconductive layer that generates an electric charge when irradiated with the radiation transmitted through the first electrode; a second electrode that is provided on a side opposite to a side where the first electrode is provided with respect to the photoconductive layer and that collects the electric charge generated by the photoconductive layer; and an organic polymer layer provided between the photoconductive layer and the first electrode, the method comprising the step of forming the organic polymer layer using the liquid coating method comprising the steps of:

ejecting droplets from nozzles of a recording head onto an imaging region of a surface of a substrate placed on a support plate;

controlling the recording head so that a dot pitch $\phi$ that is an interval between landing positions of the droplets on the surface of the substrate satisfies a following condition:

$$\phi \leq 2\sqrt[3]{\frac{3V(1+\cos\theta_a)\sin\theta_a}{\pi(1-\cos\theta_a)(2+\cos\theta_a)}}$$

where V stands for a volume of a droplet ejected from each of the nozzles and $\theta_a$ stands for an advancing contact angle of the droplet against the substrate, and controlling scanning of the recording head so that a nozzle pitch of the recording head, which is an interval along a direction perpendicular to a scanning direction along which the recording head is scanned, is an integral multiple of the dot pitch $\phi$.

* * * * *